US009152072B2

(12) United States Patent
Kato

(10) Patent No.: US 9,152,072 B2
(45) Date of Patent: Oct. 6, 2015

(54) IMAGE FORMING APPARATUS

(71) Applicant: Oki Data Corporation, Tokyo (JP)

(72) Inventor: Hiroshi Kato, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/511,662

(22) Filed: Oct. 10, 2014

(65) Prior Publication Data

US 2015/0117911 A1 Apr. 30, 2015

(30) Foreign Application Priority Data

Oct. 25, 2013 (JP) ..... 2013-222361

(51) Int. Cl.

| | |
|---|---|
| ***G03G 15/01*** | (2006.01) |
| ***G03G 15/043*** | (2006.01) |
| ***G03G 15/16*** | (2006.01) |
| ***G03G 15/00*** | (2006.01) |

(52) U.S. Cl.

CPC ..... *G03G 15/0189* (2013.01); *G03G 15/043* (2013.01); *G03G 15/1615* (2013.01); *G03G 15/5008* (2013.01)

(58) Field of Classification Search

CPC ..... G03G 15/0189; G03G 15/043; G03G 15/1615; G03G 15/5008

See application file for complete search history.

(56) References Cited

U.S. PATENT DOCUMENTS

| | | | | |
|---|---|---|---|---|
| 6,061,542 | A | 5/2000 | Minami et al. | |
| 7,255,041 | B2 * | 8/2007 | Riedel | 101/153 |
| 7,497,162 | B2 * | 3/2009 | Potzkai | 101/219 |
| 2008/0127493 | A1 * | 6/2008 | Iwasaki | 29/890.1 |
| 2010/0232819 | A1 * | 9/2010 | Kudo et al. | 399/66 |
| 2012/0207494 | A1 | 8/2012 | Tomura et al. | |
| 2012/0269530 | A1 | 10/2012 | Ohashi | |
| 2014/0233988 | A1 * | 8/2014 | Kanemura | 399/301 |

FOREIGN PATENT DOCUMENTS

| | | | |
|---|---|---|---|
| JP | 2001-134041 | A | 5/2001 |
| JP | 2011-022549 | A | 2/2011 |

* cited by examiner

*Primary Examiner* — G. M. Hyder

(74) *Attorney, Agent, or Firm* — Rabin & Berdo, P.C.

(57) ABSTRACT

An image forming apparatus includes: an endless belt having a surface on which a first image and a second image are formed; a drive roller that drives the belt; a tension roller that supports the belt on a downstream side of the drive roller; a first image forming unit disposed at a first position on an upstream side of the tension roller; a second image forming unit disposed at a second position on an upstream side of the first image forming unit; and a controller that obtains first and second image data, corrects the first and second image data so as to compensate a distortion of the second image occurring during conveyance of the second image from the second position to the first position, and causes the first and second image forming units to form the first and second images based on the corrected first and second image data.

11 Claims, 15 Drawing Sheets

FIG.13

| | 1ST BLOCK | 2ND BLOCK | ... | 79TH BLOCK | 80TH BLOCK (80) |
|---|---|---|---|---|---|
| 0TH LINE | 0 ~ 191 Dot DATA BLOCK STORING AREA | 192 ~ 383 Dot DATA BLOCK STORING AREA | ... | 14977 ~ 15168 Dot DATA BLOCK STORING AREA | 15169 ~ 15360 Dot DATA BLOCK STORING AREA |
| 1ST LINE | 0 ~ 191 Dot DATA BLOCK STORING AREA | 192 ~ 383 Dot DATA BLOCK STORING AREA | ... | 14977 ~ 15168 Dot DATA BLOCK STORING AREA | 15169 ~ 15360 Dot DATA BLOCK STORING AREA |
| 2ND LINE | 0 ~ 191 Dot DATA BLOCK STORING AREA | 192 ~ 383 Dot DATA BLOCK STORING AREA | ... | 14977 ~ 15168 Dot DATA BLOCK STORING AREA | 15169 ~ 15360 Dot DATA BLOCK STORING AREA |
| ... | ... | ... | ... | ... | ... |

IMAGE FORMING APPARATUS

BACKGROUND OF THE INVENTION

1. Field of the Invention

The present invention relates to an image forming apparatus such as a color electrographic printer (referred to below as a color printer).

2. Description of the Related Art

There is a color printer that forms monochromatic toner images of different colors on surfaces of photosensitive drums using LED (Light Emitting Diode) heads in a plurality of image forming units and while conveying a recording paper by a belt, sequentially transfers the toner images from the surfaces of the respective photosensitive drums onto a surface of the recording paper in a superposed manner.

In the color printer, depending on processing accuracy of unit parts, mounting accuracy of the LED heads, or other factors, a line of each of the toner images formed by the image forming units may be independently inclined. In such a case, when the toner images are sequentially transferred and superposed on the surface of the recording paper, color shift occurs among the toner images.

Thus, the color printer forms predetermined detection patterns by the image forming units, transfers them onto the belt surface, detects reflection intensities of the detection patterns through a reflection intensity detection unit, and detects the inclination of a line in each toner image based on the detection results. Then, in formation of a print image, the color printer corrects the inclinations of lines in the toner images on the surfaces of the photosensitive drums by controlling the LED heads in accordance with the detected inclinations, thereby preventing color shift from occurring among the toner images transferred on the recording paper (for example, see Japanese Patent Application Publication No. 2001-134041).

Further, there is a color printer of intermediate transfer type, which sequentially transfers toner images formed by image forming units onto a surface of a belt in a superposed manner and then transfers the toner images from the surface of the belt onto a surface of a recording paper.

In the color printer of intermediate transfer type, the belt is stretched by a roller and may be partially distorted. As a result, different amounts of distortion may occur in the toner images on the surface of the belt. This may cause a color shift among the toner images on the belt surface, resulting in deterioration of a print image.

SUMMARY OF THE INVENTION

An aspect of the present invention is intended to provide an image forming apparatus capable of reducing deterioration of a print image.

According to an aspect of the present invention, there is provided an image forming apparatus including: an endless belt having a surface on which a first image and a second image are sequentially formed in a superposed manner, the first image and the second image having different colors, the belt conveying the first image and the second image in a conveying direction; a drive roller that supports the belt and drives the belt in the conveying direction; a tension roller that supports the belt on a downstream side of the drive roller in the conveying direction so as to stretch the belt together with the drive roller; a first image forming unit that is disposed to face the surface of the belt at a first position on an upstream side of the tension roller in the conveying direction and forms the first image; a second image forming unit that is disposed to face the surface of the belt at a second position on an upstream side of the first image forming unit in the conveying direction and forms the second image; and a controller that obtains first image data for forming the first image and second image data for forming the second image, corrects the obtained first and second image data so as to compensate a distortion of the second image occurring during conveyance of the second image from the second position to the first position, and causes the first and second image forming units to form the first and second images based on the corrected first and second image data.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 13 is a schematic diagram for explaining storage of a plurality of head control data in a head control data storage unit;

DETAILED DESCRIPTION OF THE INVENTION

Embodiments of the invention will now be described with reference to the attached drawings.

(1) First Embodiment

(1-1) Configuration of Color Printer

Figure 1:
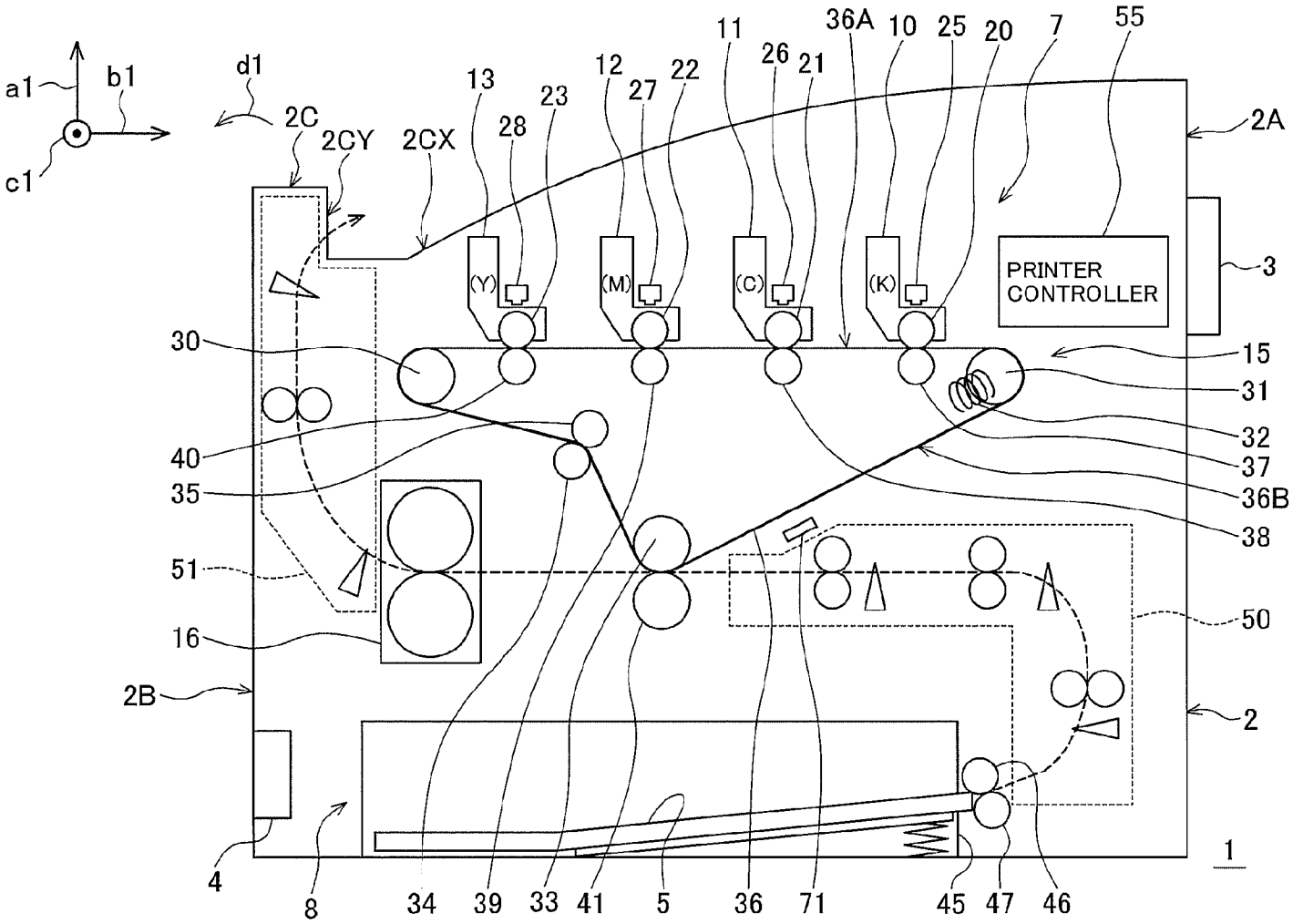
FIG. 1 is a schematic side view showing a configuration of a color printer in a first embodiment.

FIG. 1 shows a color printer 1 of intermediate transfer type in the first embodiment. For example, the color printer 1 includes a housing (referred to below as the printer housing) 2, which is substantially box-shaped and has a front face 2A on the right side of FIG. 1.

Hereinafter, when the color printer 1 is viewed from the front face 2A side, an upper direction of the color printer 1 indicated by arrow al in FIG. 1 will be also referred to as the printer upper direction; the opposite direction of the printer upper direction will be also referred to as the printer lower direction; when these directions need not be distinguished from each other, they will be also referred to as the printer vertical direction, which may indicate both the directions.

Further, when the color printer 1 is viewed from the front face 2A side, a front direction of the color printer 1 indicated by arrow b1 in FIG. 1 will be also referred to as the printer front direction; the opposite direction of the printer front direction will be also referred to as the printer rear direction; when these directions need not be distinguished from each other, they will be also referred to as the printer front-rear direction, which may indicate both the directions.

Further, when the color printer 1 is viewed from the front face 2A side, a left direction of the color printer 1 indicated by arrow c1 in FIG. 1 will be also referred to as the printer left direction; the opposite direction of the printer left direction will be also referred to as the printer right direction; when these directions need not be distinguished from each other, they will be also referred to as the printer left-right direction, which may indicate both the directions.

The color printer 1 includes an operation panel 3 having a liquid crystal panel and various operation keys. The operation panel 3 is disposed at a predetermined position in an upper part of the front face 2A of the printer housing 2. The color printer 1 further includes an external interface 4 for communicating with an external device in a wired or wireless manner according to a wired or wireless communication standard, such as USB (Universal Serial Bus) or IEEE 802 (The Institute of Electrical and Electronics Engineers 802). For example, the external interface 4 is disposed at a predetermined position in a lower part of a rear face 2B of the printer housing 2.

The color printer 1 includes a concave portion (also referred to below as the discharge tray) 2CX for receiving a recording paper 5 as a medium with a print image formed thereon. The recording paper 5 on the discharge tray 2CX can be taken by a user. The recording paper 5 has a rectangular shape, for example. The discharge tray 2CX is formed in an upper face 2C of the printer housing 2. The color printer 1 includes a recording paper outlet 2CY for discharging a recording paper 5 with a print image formed thereon from the inside of the printer housing 2 to the discharge tray 2CX. The recording paper outlet 2CY is formed at a predetermined portion of an internal wall of the printer housing 2 behind the discharge tray 2CX.

The color printer 1 includes an image forming portion 7 for forming a color print image (i.e., printing a color image to be printed) on a surface of a recording paper 5. The image forming portion 7 is disposed from the middle part to the upper end part in the printer housing 2. The color printer 1 includes a recording paper supply portion (also referred to below as the paper feed portion) 8 for supplying a recording paper 5 on which a print image is to be formed to the image forming portion 7. The paper feed portion 8 is disposed at the lower end part in the printer housing 2.

The image forming portion 7 includes four image forming units 10 to 13 that form images of different colors. Each of the image forming units 10 to 13 forms a toner image as a developer image using a monochromatic toner as a developer. The image forming units 10 to 13 use toners of different colors, for example, black (K), cyan (C), magenta (M), and yellow (Y), respectively.

The image forming portion 7 further includes a transfer unit 15 that transfers the toner images formed by the image forming units 10 to 13 onto the recording paper 5, and a fixing unit 16 that fixes the toner images of the four colors to the surface of the recording paper 5.

The image forming units 10 to 13 are disposed in the upper end part of the printer housing 2 so as to be aligned at equal intervals from the front side to the rear side in the order of black, cyan, magenta, and yellow, for example.

The image forming units 10 to 13 have the same structure except for using different color toners. Each of the image forming units 10 to 13 has a unit frame to which a toner cartridge storing a toner of corresponding color is attached.

The image forming units 10 to 13 include photosensitive drums 20 to 23 as image carriers, respectively. Each of the photosensitive drums 20 to 23 has a cylindrical or columnar shape extending in the printer left-right direction and is supported by the unit frame rotatably about a drum rotation axis parallel to the printer left-right direction in a first rotational direction indicated by arrow d1 in FIG. 1. Hereinafter, a longitudinal direction of each of the photosensitive drums 20 to 23 will be also referred to as the drum longitudinal direction; a surface of each of the photosensitive drums 20 to 23 will be also referred to as the drum surface; a circumferential direction of each of the drum surfaces will be referred to as the drum circumferential direction.

Each of the image forming units 10 to 13 further includes various rollers (not shown) extending in the printer left-right direction for forming the toner image. The various rollers are arranged around the photosensitive drum and supported by the unit frame rotatably about respective roller rotation axes parallel to the printer left-right direction in a second rotational direction opposite to the first rotational direction.

The image forming units 10 to 13 further include exposure heads 25 to 28 as image forming heads for illuminating the drum surfaces of the photosensitive drums 20 to 23 to form electrostatic latent images on which toner images are formed, respectively. Each of the exposure heads 25 to 28 extends in the left-right direction and is mounted to a predetermined mounting portion of the unit frame or printer housing 2.

Each of the four exposure heads 25 to 28 includes, for example, a circuit board and a plurality of LEDs (Light Emitting Diodes) arranged on the circuit board in a line along a longitudinal direction (also referred to below as the head longitudinal direction) of the exposure head.

Each of the exposure heads 25 to 28 further includes, on the circuit board, a drive circuit for driving the LEDs, a head information storage unit that is a nonvolatile memory, such as an EEPROM (Electrically Erasable Programmable Read Only Memory), for storing head information concerning the exposure head, or other components. Each of the exposure heads 25 to 28 further includes a lens array for focusing light emitted from the LEDs onto the drum surface of the corresponding photosensitive drum.

The transfer unit 15 includes a unit frame and disposed below and adjacent to the four image forming units 10 to 13. The transfer unit 15 further includes an endless belt (also referred to below as the transfer belt) 36 onto which the toner images formed by the image forming units 10 to 13 are transferred, and a drive roller 30 for driving the transfer belt 36. The transfer belt 36 has a surface (also referred to below as the belt surface) on which the toner images are sequentially formed in a superposed manner, and conveys the toner images in a conveying direction. The drive roller 30 supports the transfer belt 36 and drives it in the conveying direction. The drive roller 30 extends in the printer left-right direction, is disposed at a predetermined position below and behind the rearmost image forming unit 13, and is supported by the unit frame rotatably about a roller rotation axis parallel to the printer left-right direction in the second rotational direction. The image forming units 10 to 13 are disposed to face the belt surface at respective predetermined positions.

The transfer unit 15 further includes a tension roller 31 that supports the transfer belt 36 on a downstream side of the drive roller 30 in the conveying direction so as to stretch the transfer belt 36 together with the drive roller 30. The tension roller 31 extends in the printer left-right direction. The tension roller 31 is disposed at a predetermined position below and ahead of the front image forming unit 10, and supported by the unit frame rotatably about its roller rotation shaft parallel to the printer left-right direction in the second rotational direction in a state where the left end part and the right end part of the roller rotation shaft are urged forward by a pair of compression coil springs 32. The image forming units 10 to 13 are disposed on an upstream side of the tension roller 31 in order in the conveying direction. The image forming unit 10, which forms a black image, is disposed on the most downstream side in the conveying direction among the image forming units 10 to 13 so as to be adjacent to the tension roller 31.

The transfer unit 15 further includes an opposite roller 33 that extends in the printer left-right direction, is disposed at a predetermined position below the drive roller 30 and tension roller 31, and is supported by the unit frame rotatably about a roller rotation axis parallel to the printer left-right direction in the second rotational direction. The transfer unit 15 further includes a pair of driven rollers 34 and 35 that extend in the printer left-right direction, is disposed at a predetermined position between the drive roller 30 and the opposite roller 33, and is supported by the unit frame rotatably about respective roller rotation axes parallel to the printer left-right direction.

The transfer belt 36 is supported and stretched by the drive roller 30, tension roller 31, opposite roller 33, and pair of driven rollers 34 and 35 so as to form a substantially inverted triangular shape while one opening is positioned on the left side and the other opening is positioned on the right side. The transfer belt 36 has a substantially flat upper part 36A from the drive roller 30 to the tension roller 31. The upper part 36A faces the photosensitive drums 20 to 23 of the image forming units 10 to 13. The transfer belt 36 has an inclined part 36B inclined downward and rearward from the tension roller 31 to the opposite roller 33.

Hereinafter, the substantially flat upper part 36A from the drive roller 30 to the tension roller 31 will be also referred to as the belt flat part 36A; the inclined part 36B will be also referred to as the belt inclined part 36B; of the transfer belt 36, a part contacting the tension roller 31 and being stretched by the tension roller 31 will be also referred to as the tension roller stretched part.

Further, the one opening on the left side of the transfer belt 36 will be also referred to as the belt left opening; the other opening on the right side of the transfer belt 36 will be also referred to as the belt right opening; a width direction along the width between the belt left opening and the belt right opening of the transfer belt 36 will be also referred to as the belt width direction.

The transfer unit 15 further includes four primary transfer rollers 37 to 40 for transferring the toner images from the drum surfaces of the four photosensitive drums 20 to 23 onto the belt surface of the transfer belt 36, respectively. The primary transfer rollers 37 to 40 extend in the printer left-right direction, are disposed inside the belt flat part 36A of the transfer belt 36 so as to be sequentially arranged from the front side to the rear side, and are supported by the unit frame rotatably about respective roller rotation axes parallel to the printer left-right direction in the second rotational direction.

The transfer unit 15 presses the upper parts of the surfaces of the primary transfer rollers 37 to 40 against the lower parts of the drum surfaces of the corresponding photosensitive drums 20 to 23 with the belt flat part 36A of the transfer belt 36 therebetween. Hereinafter, on the belt surface of the belt flat part 36A of the transfer belt 36, each of the positions contacting the drum surfaces of the photosensitive drums 20 to 23 will be also referred to as a primary transfer position.

The transfer unit 15 further includes a secondary transfer roller 41 for transferring the toner images conveyed on the belt surface by the rotation of the transfer belt 36 onto the surface of the recording paper 5. The secondary transfer roller 41 extends in the printer left-right direction, and is disposed below the opposite roller 33 rotatably about a roller rotation axis parallel to the printer left-right direction in the first rotational direction. The upper part of the surface of the secondary roller 41 is pressed against the lower part of the surface of the opposite roller 33 with the transfer belt 36 therebetween.

Hereinafter, on the belt surface of the transfer belt 36, a position contacting the surface of the secondary transfer roller 41 will be also referred to as the secondary transfer position; the conveying direction, in which toner images on the belt surface are conveyed by the rotation of the transfer belt 36, will be also referred to as the belt conveying direction; at various positions, an upstream side and a downstream side in the belt conveying direction will be also referred to as the belt conveying direction upstream side and belt conveying direction downstream side, respectively. The fixing unit 16 applies heat and pressure to the toner images of four colors on the surface of the recording paper 5, and is disposed behind the secondary transfer position of the transfer unit 15.

The paper feed portion 8 includes a paper feed tray 45 in which a plurality of recording papers 5 are stored in a stacked manner with their longitudinal directions parallel to the printer front-rear direction. The paper feed portion 8 further includes a pickup roller 46 for picking up the recording papers 5 from the paper feed tray 45. The pickup roller 46 is disposed rotatably about a roller rotation axis parallel to the printer left-right direction in the first rotational direction.

The paper feed portion 8 further includes a retard roller 47 for, when two recording papers 5 are picked up from the paper feed tray 45 by the pickup roller 46 in a stacked state, separating the recording papers 5 one by one and feeding only one of the recording papers 5. The retard roller 47 has a roller rotation shaft parallel to the printer left-right direction.

In addition, a conveying portion (also referred to below as the paper feed conveying portion) 50 is disposed in the printer housing 2 from a position ahead of and above the paper feed tray 45 to a position ahead of the secondary transfer roller 41 and opposite roller 33. The paper feed conveying portion 50 conveys and feeds a recording paper 5 to the image forming portion 7. The paper feed conveying portion 50 forms a conveying path (also referred to below as the paper feed conveying path) for conveying a recording paper 5 picked up from the paper feed tray 45 to the image forming portion 7 by a variety of conveying path forming parts, such as a plurality of pairs of conveying rollers, a pair of transfer position adjustment rollers for adjusting a transfer position at which the four color toner images are transferred onto the surface of the recording paper 5 by the secondary transfer roller 41, a plurality of conveying guides, a paper feed conveying motor, and various sensors for controlling the conveyance.

Further, a conveying portion (also referred to below as the discharge conveying portion) 51 is disposed in the printer housing 2 from a position behind the fixing unit 16 to the recording paper outlet 2CY. The discharge conveying portion 51 conveys the recording paper 5 with the print image formed thereon to discharge it from the recording paper outlet 2CY. The discharge conveying portion 51 forms a conveying path (also referred to below as the discharge conveying path) for conveying the recording paper 5 discharged from the fixing unit 16 to the recording paper outlet 2CY by a variety of conveying path forming parts, such as a plurality of pairs of conveying rollers, a plurality of conveying guides, a discharge conveying motor, and various sensors for controlling the conveyance.

The color printer 1 further includes, in the printer housing 2, a printer controller 55 that controls the entire color printer 1. The color printer 1 is connected, in a wired or wireless manner, via the external interface 4 to a host device (not shown), such as a personal computer, that instructs the color printer 1 to print a color image to be printed.

For example, when the printer controller 55 receives print image data representing a color image to be printed and an instruction to print the color image from the host device, it executes a print image forming process to form (i.e., print) a print image on a surface of a recording paper 5.

At this time, in order to form toner images, the printer controller 55 controls a predetermined image unit drive motor to rotate the photosensitive drums 20 to 23 and various rollers of the image forming units 10 to 13 in the first or second rotational direction. The printer controller 55 applies a predetermined voltage for forming toner images from a predetermined image unit voltage source to the various rollers of the image forming units 10 to 13.

Further, the printer controller 55 controls a predetermined transfer unit drive motor to rotate the drive roller 30 of the transfer unit 15 in the second rotational direction, thereby rotating the transfer belt 36 in the second rotational direction. The tension roller 31, opposite roller 33, and pair of driven rollers 34 and 35 rotate with the transfer belt 36.

In addition, the printer controller 55 applies a predetermined voltage for transferring toner images from a predetermined transfer unit voltage source to the primary transfer rollers 37 to 40 and secondary transfer roller 41 of the transfer unit 15. The printer controller 55 controls a predetermined fixing unit drive motor and a predetermined heating power source to drive the fixing unit 16 to apply heat and pressure to toner images.

In this state, the printer controller 55 drives the paper feed conveying motor and discharge conveying motor to drive the paper feed conveying portion 50 and discharge conveying portion 51, and then controls a predetermined pickup motor to rotate the pickup roller 46 in the first rotational direction, thereby picking up the recording papers 5 one by one from the paper feed tray 45 and conveying the recording papers 5 to the image forming portion 7 via the paper feed conveying path.

The printer controller 55 starts to control the exposure heads 25 to 28 of the image forming units 10 to 13 in order from rear to front in accordance with corresponding color components (yellow, magenta, cyan, and black) of the color image to be printed based on the print image data. The printer controller 55 forms electrostatic latent images on the drum surfaces of the photosensitive drums 20 to 23 by using the exposure heads 25 to 28 and develops the electrostatic latent images with the monochromatic toners supplied from the toner cartridges to form toner images.

The printer controller 55 transfers the toner images of four colors from the drum surfaces of the photosensitive drums 20 to 23 onto the belt surface of the transfer belt 36 so as to superpose the toner images in the order of yellow, magenta, cyan, and black. While the printer controller 55 conveys the four color toner images to the secondary transfer position by the transfer belt 36, it conveys a recording paper 5 via the paper feed conveying path to the secondary transfer position. Then, while interposing and conveying the recording paper 5 between the transfer belt 36 and the secondary transfer roller 41, the printer controller 55 transfers the four color toner images from the belt surface of the transfer belt 36 onto the surface of the recording paper 5, delivering it to the fixing unit 16.

Then, by the fixing unit 16, the printer controller 55 applies heat and pressure to the recording paper 5 while conveying it, thereby melting the four color toner images and fixing them on the surface of the recording paper 5 to form a color print image. Then, the printer controller 55 conveys the recording paper 5 through the discharge conveying path to discharge it from the recording paper outlet 2CY to the discharge tray 2CX. In this way, the printer controller 55 can deliver the recording paper 5 with the color print image formed thereon via the discharge tray 2CX to a user.

In this embodiment, the printer controller 55 performs image correction as follows. In the following description regarding the image correction, one of the image forming units 10 to 12 will be referred to as the first image forming unit, and one of the image forming units 11 to 13 that is disposed on an upstream side of the first image forming unit in the conveying direction will be referred to as the second image forming unit; the toner image formed by the first image forming unit will be referred to as the first image, and the toner image formed by the second image forming unit will be referred to as the second image; the position at which the first image forming unit faces the belt surface will be referred to as the first position, and the position at which the second image forming unit faces the belt surface will be referred to as the second position.

The printer controller 55 obtains first image data for forming the first image and second image data for forming the second image. The first and second image data may be included in the print image data. The printer controller 55 corrects the obtained first and second image data so as to compensate or cancel a distortion of the second image occurring during conveyance of the second image from the second position to the first position, and causes the first and second image forming units to form the first and second images based on the corrected first and second image data.

The printer controller 55 may correct the first image data so as to deform an image represented by the first image data by a first amount, and correct the second image data so as to deform an image represented by the second image data by a second amount different from the first amount. The difference between the first amount and the second amount may correspond to the amount of the distortion of the second image.

When the first image forming unit is the image forming unit 10, the printer controller 55 does not correct the first image data. That is, the printer controller 55 does not correct image data for black.

In one aspect, the first image data include a plurality of data blocks corresponding to a plurality of blocks constituting the first image; the second image data include a plurality of data blocks corresponding to a plurality of blocks constituting the second image. The printer controller 55 transmits the plurality of data blocks of the first image data to the first image forming unit and transmits the plurality of data blocks of the second image data to the second image forming unit. The first image forming unit forms the plurality of blocks of the first image based on the plurality of data blocks of the first image data according to the order in which the plurality of data blocks of the first image data are transmitted to the first image forming unit. The second image forming unit forms the plurality of blocks of the second image based on the plurality of data blocks of the second image data according to the order in which the plurality of data blocks of the second image data are transmitted to the second image forming unit. The printer controller 55 obtains a first correction value and a second correction value for compensating the distortion of the second image. The printer controller 55 corrects the first image data by controlling the order in which the plurality of data blocks of the first image data are transmitted to the first image forming unit, by the data block, based on the first correction value, and corrects the second image data by controlling the order in which the plurality of data blocks of the second image data are transmitted to the second image forming unit, by the data block, based on the second correction value.

The printer controller 55 may further obtain a first inclination correction value and a second inclination correction value for compensating a difference between an inclination of the first image occurring in the formation of the first image and an inclination of the second image occurring in the formation of the second image. The printer controller 55 may correct the first image data by controlling the order based on the first correction value and the first inclination correction value, and correct the second image data by controlling the order based on the second correction value and the second inclination correction value. When one of the first and second images is a black image, one of the first and second inclination correction values corresponding to the one image indicates that one of the first and second image data corresponding to the one image are not corrected, and the other of the first and second inclination correction values indicates that the other of the first and second image data are corrected.

The printer controller 55 may further obtain a first distortion correction value and a second distortion correction value for compensating a difference between a distortion of the first image occurring in the formation of the first image and a distortion of the second image occurring in the formation of the second image. The printer controller 55 may correct the first image data by controlling the order based on the first correction value and the first distortion correction value, and correct the second image data by controlling the order based on the second correction value and the second distortion correction value. When one of the first and second images is a black image, one of the first and second distortion correction values corresponding to the one image indicates that one of the first and second image data corresponding to the one image are not corrected, and the other of the first and second distortion correction values indicates that the other of the first and second image data are corrected.

The above image correction will be described more specifically below.

(1-2) Circuit Configuration of Printer Controller

Figure 2:
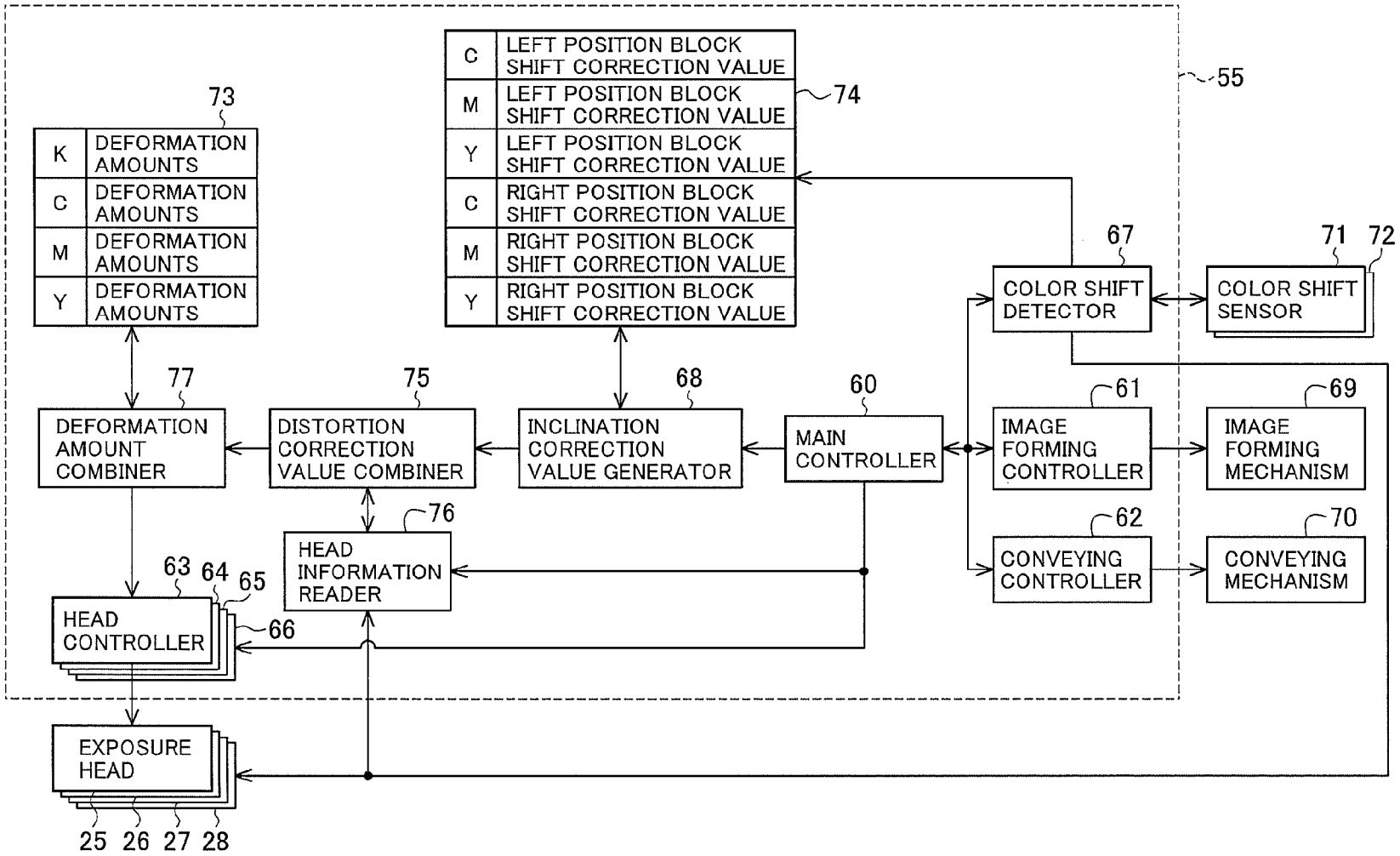
FIG. 2 is a block diagram showing a circuit configuration of a printer controller in the first embodiment.

Next, the circuit configuration of the printer controller 55 will be described with reference to FIG. 2. As shown in FIG. 2, the printer controller 55 includes a main controller 60 that controls the entire printer controller 55. The main controller 60 is configured using, for example, a microprocessor. The main controller 60 is connected to an image forming controller 61, a conveying controller 62, four head controllers 63 to 66 respectively corresponding to the exposure heads 25 to 28 of the four image forming units 10 to 13, a color shift detector 67, and an inclination correction value generator 68.

The image forming controller 61 is connected to an image forming mechanism 69 for driving the image forming portion 7 except for the exposure heads 25 to 28. The image forming mechanism 69 includes the image unit drive motor, transfer unit drive motor, fixing unit drive motor, image unit voltage source, transfer unit voltage source, and heating power source. The conveying controller 62 is connected to a conveying mechanism 70 for driving the paper feed conveying portion 50, discharge conveying portion 51, and pickup roller 46. The conveying mechanism 70 includes the paper feed conveying motor, discharge conveying motor, pickup motor, and various sensors for controlling the conveyance.

When forming a print image, the main controller 60 generates four types of head control data for individually controlling the four exposure heads 25 to 28 based on four types of color data representing respective color components of black, cyan, magenta, and yellow of a color image included in the print image data. The main controller 60 transmits the generated four types of head control data to the corresponding head controllers 63 to 66.

Under control of the main controller 60, the image forming controller 61 controls the image forming mechanism 69 to drive the image forming portion 7 except for the exposure heads 25 to 28 to form a print image; the conveying controller 62 controls the conveying mechanism 70 to drive the paper feed conveying portion 50, discharge conveying portion 51, and pickup roller 46 to convey a recording paper 5.

In this state, the head controllers 63 to 66 transmit the corresponding head control data to the corresponding exposure heads 25 to 28. The exposure heads 25 to 28 appropriately drive (or turn on/off) the LEDs by the drive circuits based on the head control data to illuminate the drum surfaces of the photosensitive drums 20 to 23.

While the main controller 60 forms electrostatic latent images by the exposure heads 25 to 28 on the drum surfaces of the photosensitive drums 20 to 23 as described above, it forms toner images of four colors based on the electrostatic latent images, transfers the four color toner images onto the belt surface of the transfer belt 36 so as to sequentially superpose the toner images, and then transfers the toner images from the transfer belt 36 onto the surface of the recording paper 5, thereby forming a print image.

Figure 3:
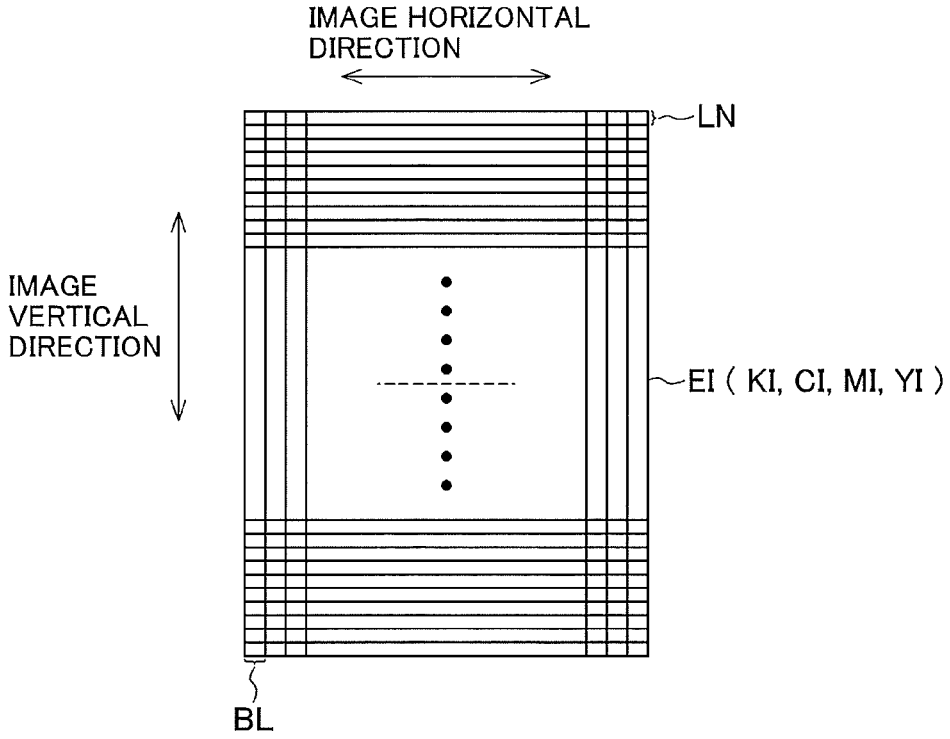
FIG. 3 schematically shows configurations of electrostatic latent images and toner images.

As shown in FIG. 3, each of the electrostatic latent images EI corresponding to black, cyan, magenta, and yellow in this embodiment consists of a plurality of lines LN that are parallel to an image horizontal direction and arranged in an image vertical direction; each of the lines LN consists of a plurality of (e.g., 80) blocks BL.

Each of the blocks BL consists of, for example, a plurality of (e.g., 192) dots arranged in a line in the image horizontal direction. Thus, each of the lines LN, which is composed of the plurality of blocks BL, is composed of the plurality of (e.g., 15360) dots in the plurality of blocks BL arranged in a line in the image horizontal direction.

Each of the toner images KI, CI, MI, and YI formed based on the electrostatic latent images EI is different from the electrostatic latent image EI in that the toner image represents the dots in the electrostatic latent image EI with the toner of the corresponding color, but consists of a plurality of lines LN that are arranged in the image vertical direction and each composed of a plurality of blocks BL, in the same manner as the electrostatic latent image EI.

Each of the exposure heads 25 to 28 includes the same number of (e.g., 15360) LEDs arranged in a line along the head longitudinal direction as the number of dots in a line LN in the electrostatic latent image EI so as to individually form the dots in a line LN in the electrostatic latent image EI.

Each of the exposure heads 25 to 28 appropriately drives the LEDs based on the head control data to illuminate the drum surface of the corresponding photosensitive drum, thereby sequentially forming the electrostatic latent image EI on the drum surface by the line LN extending from left to right. The image forming units 10 to 13 develop the electrostatic latent images EI with the toners to form the toner images KI, CI, MI, and YI on the drum surfaces of the photosensitive drums 20 to 23, respectively.

Each of the image forming units 10 to 13 is configured to form the electrostatic latent image EI and the toner image KI, CI, MI, or YI on the drum surface of the photosensitive drum in such a manner that the image horizontal direction is substantially parallel to the drum longitudinal direction (or printer left-right direction) and the image vertical direction is along the drum circumferential direction.

The transfer unit 15 is configured to transfer the toner images KI, CI, MI, and YI from the drum surfaces of the photosensitive drums 20 to 23 onto the belt surface of the transfer belt 36 in accordance with the orientation of the toner images KI, CI, MI, and YI formed by the image forming units 10 to 13 in such a manner that the image horizontal directions are substantially parallel to the belt width direction (or printer left-right direction) and the image vertical directions are along the belt conveying direction.

However, each of the exposure heads 25 to 28 may be mounted to the predetermined mounting portion with its head longitudinal direction (i.e., direction in which the LEDs are aligned) slightly inclined with respect to the drum longitudinal direction, depending on the mounting accuracy of the exposure head, for example. Thus, each of the exposure heads 25 to 28 may be mounted to the predetermined mounting portion in a state where both ends of the LEDs arranged in a line are displaced from each other back and forth by an amount corresponding to one or more lines LN.

Figure 4A:
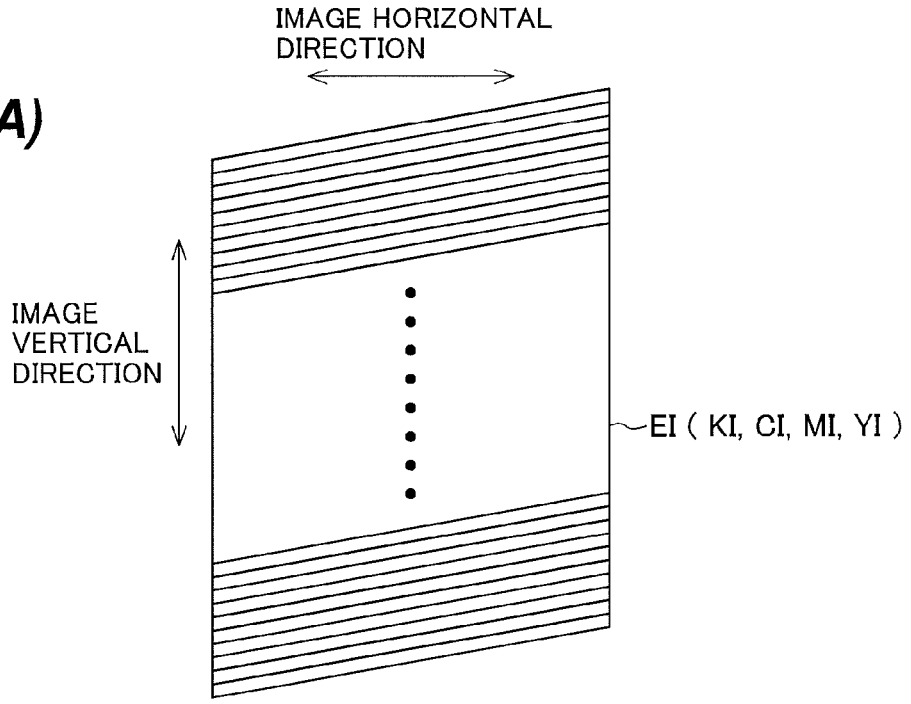
FIGS. 4(A) and 4(B) schematically show configurations of electrostatic latent images and toner images formed with respective lines inclined.
Figure 4B:
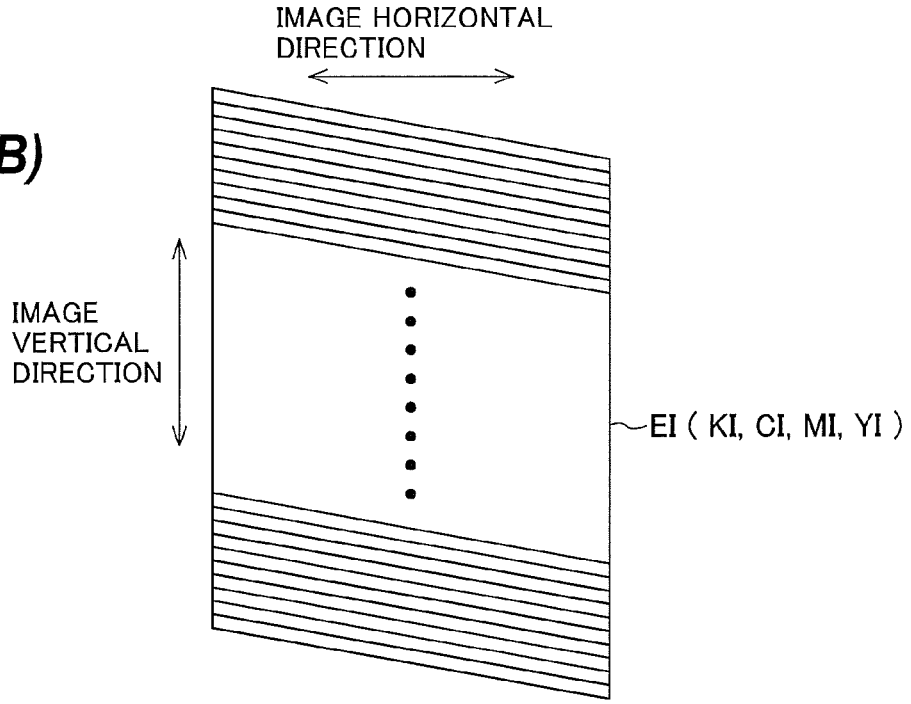

In such a case, as shown in FIGS. 4(A) and 4(B), each of the image forming units 10 to 13 sequentially forms the respective lines LN of the electrostatic latent image EI on the drum surface of the photosensitive drum by the exposure head with the respective lines LN slightly inclined with respect to the drum longitudinal direction.

Therefore, each of the image forming units 10 to 13 develops the electrostatic latent image EI with the toner to form toner image KI, CI, MI, or YI on the drum surface of the photosensitive drum with the respective lines LN of the toner image slightly inclined with respect to the drum longitudinal direction. Hereinafter, the inclination occurring in each of the lines LN of the electrostatic latent images EI and toner images KI, CI, MI, and YI will be also referred to as the line inclination.

In the color printer 1, when the amount of line inclination (including presence or absence of the line inclination) differs among the toner images KI, CI, MI, and YI, the toner images KI, CI, MI, and YI are transferred and superposed on the belt surface of the transfer belt 36 in such a manner that the left ends (one ends in the image horizontal direction) and the right ends (the other ends in the image horizontal direction) of the toner images are displaced from each other in the image vertical direction. As a result, a color shift in the image vertical direction (or belt conveying direction) occurs among at least two of the toner images KI, CI, MI, and YI on the belt surface of the transfer belt 36.

Figure 5:
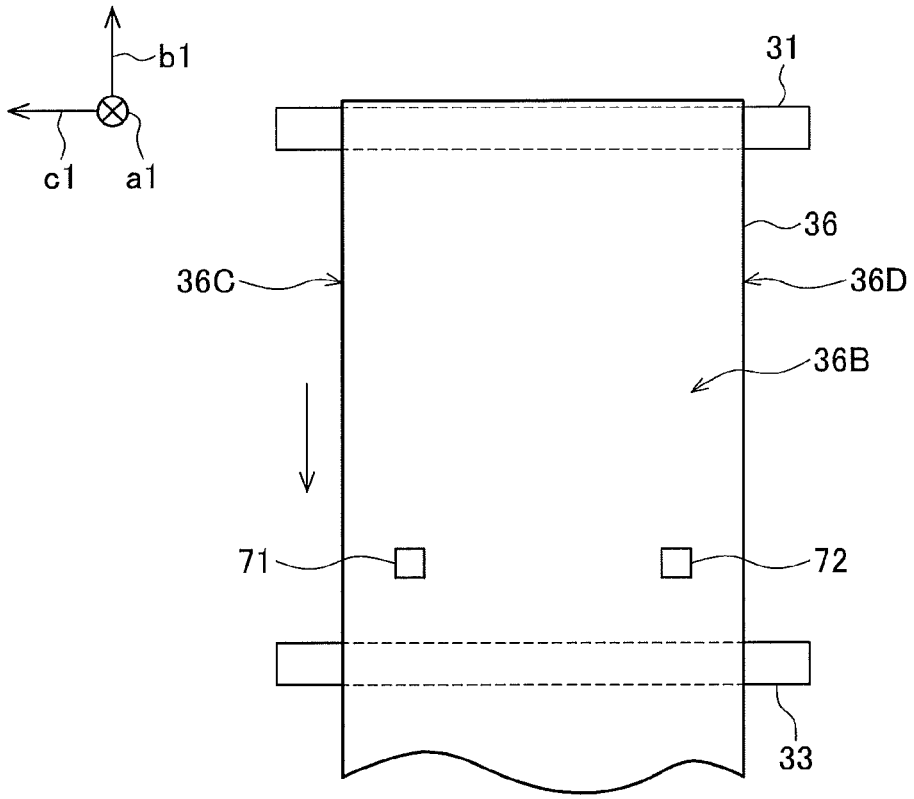
FIG. 5 is a schematic bottom view for explaining arrangement positions of a left color shift sensor and a right color shift sensor.

In order to address this, as shown in FIG. 5, the color printer 1 includes a pair of color shift sensors 71 and 72 that have the same structure and used for detecting the amounts of color shift in the image vertical direction at two right and left positions with respect to the four color toner images KI, CI, MI, and YI on the belt surface. For example, the pair of color shift sensors 71 and 72 are arranged along the printer left-right direction so as to be close to (in a non-contact manner) the belt surface of the belt inclined part 36B of the transfer belt 36 on the opposite roller 33 side in the vicinities of the belt left opening 36C and belt right opening 36D.

Each of the pair of color shift sensors 71 and 72 includes a light emitting element and a light receiving element, and is configured to irradiate the belt surface of the transfer belt 36 with detection light emitted from the light emitting element and receive reflection light generated by reflection of the detection light from the belt surface by the light receiving element. The pair of color shift sensors 71 and 72 are connected to the color shift detector 67.

Hereinafter, the color shift sensor 71, which is arranged near the belt left opening 36C of the transfer belt 36, will be also referred to as the left color shift sensor 71; the color shift sensor 72, which is arranged near the belt right opening 36D of the transfer belt 36, will be also referred to as the right color shift sensor 72.

Each of the exposure heads 25 to 28 includes, for example, the same number of (e.g., 80) LED array chips as the number of blocks BL constituting a line LN of the electrostatic latent image EI. Each of the LED array chips is formed by arranging in a line the same number of (e.g., 192) LEDs as the number of dots in a block BL in the electrostatic latent image EI so as to individually form the dots in a block BL of the electrostatic latent image EI.

Each of the exposure heads 25 to 28 is configured in such a manner that the LED array chips are mounted on the circuit board in a line along the head longitudinal direction, so that the LEDs corresponding to a line LN of the electrostatic latent image EI are arranged in a line as described above.

The LEDs in each LED array chip are aligned substantially in a straight line since a highly accurate manufacturing technique has been established, for example. Hereinafter, the LEDs arranged in a line in a LED array chip will be also collectively referred to as an LED array.

However, in each of the exposure heads 25 to 28, depending on chip mounting accuracy or other factors, at least one of the LED array chips may be mounted on the circuit board at a position displaced from a reference mounting position in a direction perpendicular to the head longitudinal direction by an amount corresponding to one or more lines LN of the electrostatic latent image EI.

In such a case, in each of the exposure heads 25 to 28, the displacement of the mounting position of an LED array chip leads to displacement of the LED array relative to the line of the LEDs corresponding to a line LN of the electrostatic latent image EI. Thus, in each of the exposure heads 25 to 28, the line of the LEDs is distorted due to displacement of the LEDs by the LED array. Hereinafter, the distortion occurring in the line of the LEDs corresponding to a line LN of the electrostatic latent image EI in each of the exposure heads 25 to 28 will be also referred to as the head distortion.

When the exposure heads 25 to 28 have the head distortions, the image forming units 10 to 13 sequentially form the respective lines LN of the electrostatic latent images EI on the drum surfaces of the photosensitive drums 20 to 23 by the exposure heads 25 to 28 with the respective lines LN distorted similarly to the head distortions.

Then, the image forming units 10 to 13 develop the electrostatic latent images EI with the toners to form toner images KI, CI, MI, and YI on the drum surfaces of the photosensitive drums 20 to 23 with the respective lines LN of the toner images distorted similarly to the head distortions. Hereinafter, the distortion occurring in each line LN in the electrostatic latent images EI and toner images KI, CI, MI, and YI due to the head distortions similarly to the head distortions will be also referred to as the line distortion.

In the color printer 1, when the amount of line distortion differs among the toner images KI, CI, MI, and YI formed by the image forming units 10 to 13, a color shift in the image vertical direction (or belt conveying direction) occurs among the four color toner images KI, CI, MI, and YI transferred on the belt surface of the transfer belt 36.

In order to address this, for each of the exposure heads 25 to 28, a distortion amount (also referred to below as a head distortion amount) representing the amount of head distortion is obtained or measured for each LED array. The distortion amount is obtained when the exposure head is manufactured, for example. Information indicating the head distortion amount of each LED array is stored as the head information in the head information storage unit in each of the exposure heads 25 to 28.

The head distortion amount of each LED array represents the amount of head distortion, including presence or absence of head distortion, with a distance and a direction of displacement of the LED array from the line of the LEDs. In this embodiment, the distance and direction of displacement of the LED array correspond to the distance and direction of displacement of the LED array chip including the LED array from the reference mounting position, for example.

When an LED array chip is mounted at the reference mounting position, the head distortion amount of the LED array of the LED array chip is generated to represent, with for example a value '0', that no head distortion occurs in the LED array. When an LED array chip is mounted at a position displaced from the reference mounting position, the head distortion amount of the LED array of the LED array chip is generated to represent the amount of head distortion of the LED array with the number of lines indicating the distance of displacement of the LED array chip and a sign indicating the direction of displacement of the LED array chip, for example.

Figure 6:
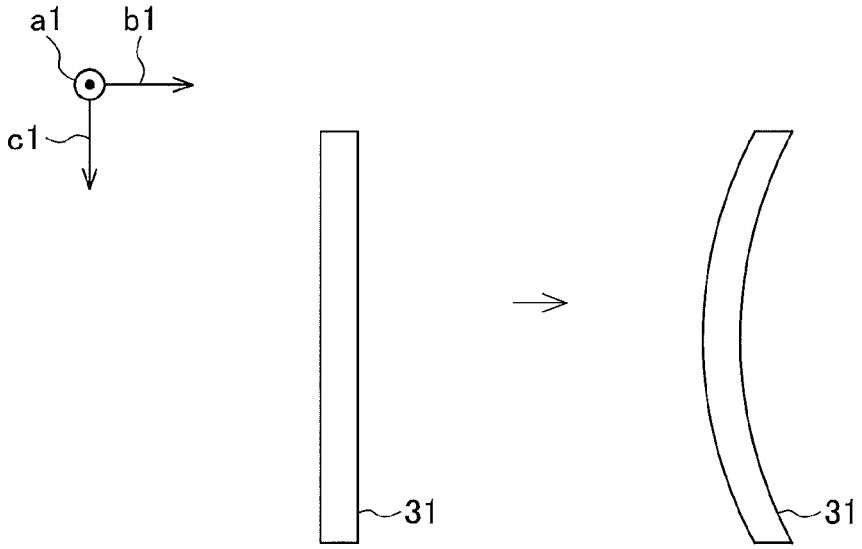
FIG. 6 is a schematic top view for explaining deflection occurring in a tension roller.

Further, as described above, the transfer unit 15 continuously urges the left end part and the right end part of the roller rotation shaft of the tension roller 31 forward by the pair of compression coil springs 32 with relatively large urging force, thereby applying tension to the transfer belt 36 through the tension roller 31. However, as shown in FIG. 6, since the tension roller 31 is applied with force from the transfer belt 36 so as to be pulled rearward, the tension roller 31 is bent in such a manner that its central part projects rearward, and rotates in the second rotational direction in the bent state while the transfer belt 36 rotates in the second rotational direction during formation of a print image.

Figure 7:
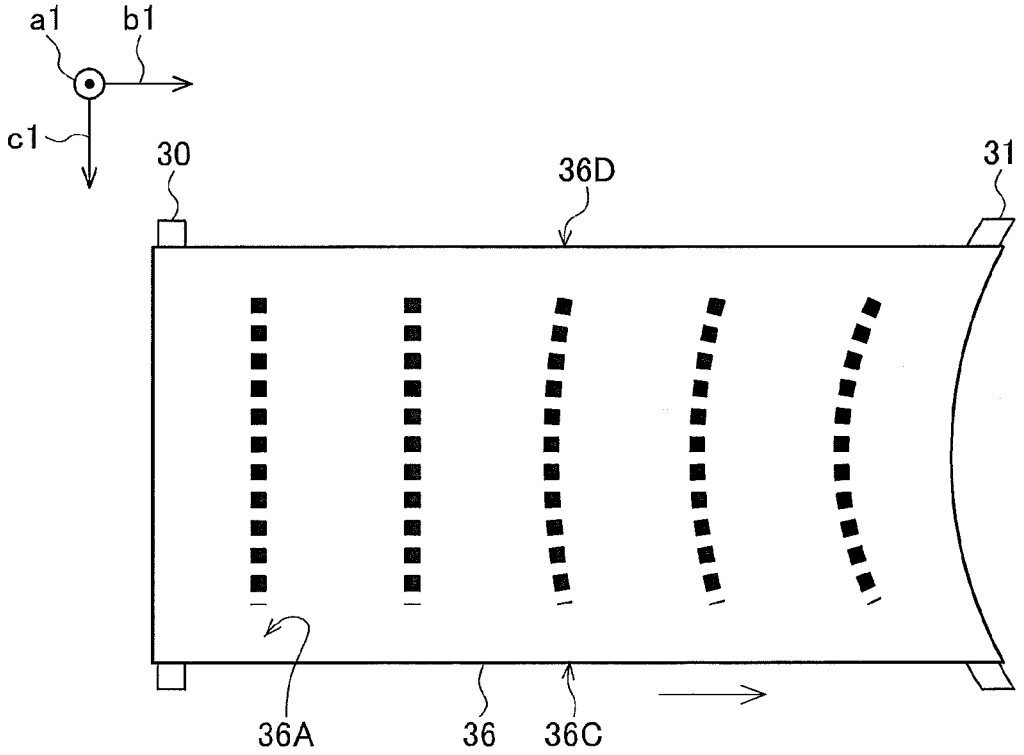
FIG. 7 is a schematic top view for explaining belt distortion occurring in a transfer belt due to the deflection of the tension roller.

As shown in FIG. 7, since the transfer belt 36 is applied with tension by the bent tension roller 31, it is distorted in such a manner that the tension roller stretched part is curved inward in an arcuate concave shape. During formation of a print image, the transfer belt 36 rotates in the second rotational direction in the distorted state. Hereinafter, the distortion occurring in the transfer belt 36 will be also referred to as the belt distortion.

FIG. 7 schematically shows the belt distortion occurring in the transfer belt 36 with five dotted lines. In the belt flat part 36A, while the belt distortion is significantly small on the drive roller 30 side relatively away from the tension roller 31, it becomes gradually larger from the drive roller 30 side toward the tension roller 31 side and becomes the largest at the tension roller stretched part.

Although not shown, in the belt inclined part 36B, while the belt distortion is relatively small on the opposite roller 33 side (i.e., secondary transfer position side) relatively away from the tension roller 31, it becomes gradually larger from the opposite roller 33 side toward the tension roller 31 side and becomes the largest at the tension roller stretched part.

Figure 8:
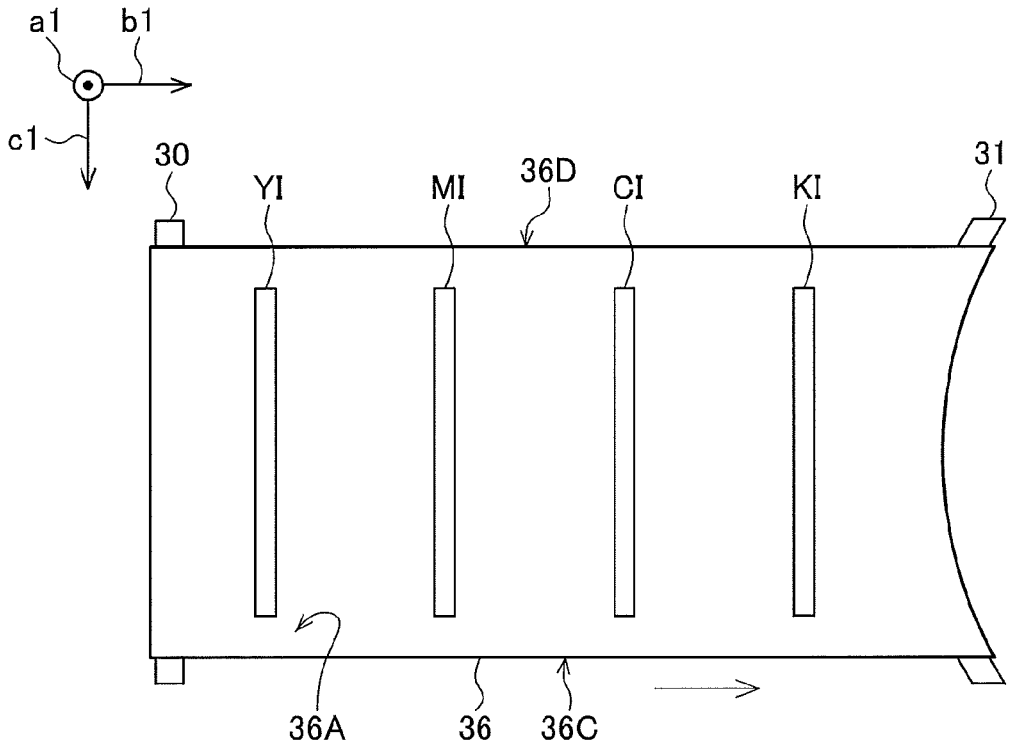
FIG. 8 is a schematic top view for explaining transfer of toner images of four colors onto a belt surface of the transfer belt having the belt distortion.

In the transfer unit 15, during formation of a print image, the primary transfer rollers 37 to 40 are applied with voltages different from those applied to the photosensitive drums 20 to 23, so that the coulomb force is exerted therebetween. The transfer unit 15 transfers the toner images KI, CI, MI, and YI formed on the drum surfaces of the photosensitive drums 20 to 23 onto the belt surface at the primary transfer positions by the coulomb force while maintaining the shapes of the toner images regardless of the belt distortion, as shown in FIG. 8.

Figure 9:
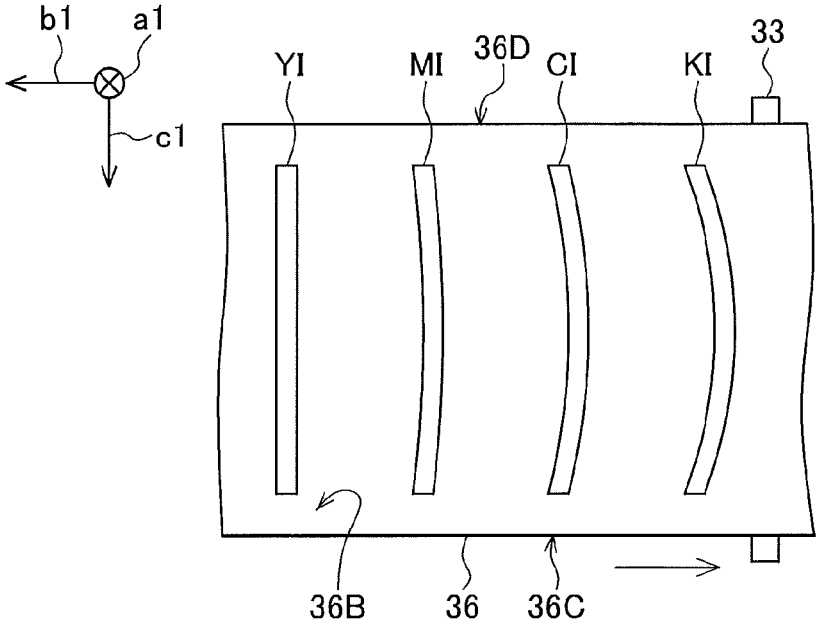
FIG. 9 is a schematic bottom view for explaining image distortion occurring in the toner images of four colors at a secondary transfer position on the belt surface of the transfer belt.

As shown in FIG. 9, the transfer unit 15 conveys the toner images KI, CI, MI, and YI by the rotation of the transfer belt 36 in the second rotational direction from the belt flat part 36A on the belt conveying direction upstream side of the tension roller stretched part via the tension roller stretched part and belt inclined part 36B to the secondary transfer position on the belt conveying direction downstream side of the tension roller stretched part.

Hereinafter, a portion of the transfer belt 36 at which the toner images KI, CI, MI, and YI are transferred will be referred to as the image transferred portion. When the toner images are transferred onto the image transferred portion, since the image transferred portion is located in the belt flat part 36A, the image transferred portion has a relatively large belt distortion, as described above. When the image transferred portion moves together with the toner images KI, CI, MI, and YI to the secondary transfer position, the belt distortion of the image transferred portion becomes relatively small. In this manner, the belt distortion of the image transferred portion decreases. In other words, the image transferred portion deforms.

Due to the deformation of the image transferred portion of the transfer belt 36, the toner images KI, CI, MI, and YI on the belt surface are distorted at the secondary transfer position in such a manner that the entire images (i.e., respective lines LN) are curved in arcuate shapes so as to project toward the belt conveying direction downstream side (or in one of the image vertical directions), that is, in a direction opposite to those of the belt distortions at the primary transfer positions. Hereinafter, the distortion occurring in each of the toner images KI, CI, MI, and YI due to the belt distortion will be also referred to as the image distortion.

The image forming units 10 to 13 corresponding to black, cyan, magenta, and yellow are arranged from the tension roller 31 side, on which the belt distortion is large, toward the drive roller 30 side, on which the belt distortion is significantly small.

Each of the toner images KI, CI, MI, and YI is transferred from the photosensitive drum onto the image transferred portion at the corresponding primary transfer position in the belt flat part 36A while maintaining its shape. The image transferred portion has different amounts of belt distortion at the respective primary transfer positions.

Therefore, the amount of change in the belt distortion of the image transferred portion from the primary transfer position to the secondary transfer position differs among the four colors. Thus, in accordance with the different amounts of change in the belt distortion, different amounts of image distortion occur in the toner images KI, CI, MI, and YI at the secondary transfer position.

Each of the image distortions of the toner images KI, CI, MI, and YI substantially uniformly deforms the entire image (i.e., respective lines LN) in one of the image vertical directions. However, due to the difference in the amount of change in the belt distortion, the image distortions occurring in the yellow toner image YI, magenta toner image MI, cyan toner image MI, and black toner image KI are larger in this order.

FIG. 9 illustrates toner images KI, CI, MI, and YI of four colors. Although the illustrated toner images KI, CI, MI, and YI are actually sequentially transferred and superposed on the belt surface of the transfer belt 36, they are depicted in such a manner that they are separated from each other at intervals corresponding to several lines LN, in order to facilitate understanding of the image distortions occurring in the toner images KI, CI, MI, and YI on the belt surface.

In the color printer 1, when the different amounts of image distortion occur in the toner images KI, CI, MI, and YI at the secondary transfer position on the belt surface, a color shift in the image vertical direction (or belt conveying direction) occurs among the toner images KI, CI, MI, and YI.

The amount of image distortion of each toner image corresponds to at most several lines LN, for example. Thus, it is so small that it is almost unperceivable when a print image composed of a toner image of single color is viewed by human eyes, for example.

However, for example, when a print image composed of the four color toner images KI, CI, MI, and YI is viewed by human eyes, the color shift among the toner images can easily be perceived as color blurring, line blurring, or other image defects.

Such a color shift may be reduced or removed by forming the toner images KI, CI, MI, and YI (specifically, by correcting the print image data or head control data) so as to compensate or cancel the difference in the amount of image distortion among the toner images KI, CI, MI, and YI. For each of the exposure heads 25 to 28, the above described head control data consists of the same number of (e.g., 15360) LED control data as the number of LEDs in the exposure head so that the LEDs in the exposure head can be driven individually; the main controller 60 (FIG. 2) generates the head control data for each line LN of the electrostatic latent image EI.

The head control data are divided into the same number of (e.g., 80) data blocks as the number of LED array chips. Each of the data blocks consists of a plurality of (e.g., 192) LED control data corresponding to the LEDs in the LED array chip, and is used for controlling the LEDs in the LED array chip.

The main controller 60 can individually replace each data block in the head control data for each line LN with another data block and thereby change the control contents for the LEDs in the exposure heads 25 to 28 by the LED array.

The main controller 60 generates head control data for each line LN of the electrostatic latent images EI by the data block in accordance with the image distortions of the toner images KI, CI, MI, and YI. For example, the main controller 60 configures head control data for each line LN of the electrostatic latent images EI based on the print image data, and then reconfigures the head control data by the data block in accordance with the image distortions of the toner images KI, CI, MI, and YI so as to change the configuration of each line LN of the electrostatic latent images EI by the block BL. The main controller 60 controls the exposure heads 25 to 28 based on the reconfigured head control data. That is, the main controller 60 corrects the head control data so as to deform the image represented by the head control data (or the electrostatic latent images EI) in accordance with the image distortions, and then forms the electrostatic latent images EI according to the corrected head control data.

Thus, the main controller 60 forms the electrostatic latent images EI on the drum surfaces of the photosensitive drums 20 to 23 while appropriately deforming the electrostatic latent images EI by the block BL in advance, thereby appropriately deforming the toner images KI, CI, MI, and YI formed from the electrostatic latent images EI by the block BL. In this way, the main controller 60 cancels or compensates the difference among the image distortions of the toner images KI, CI, MI, and YI.

However, the deformation of the toner images KI, CI, MI, and YI by the block BL may cause jaggy on continuous lines, such as curved lines or straight lines, in pictures in the toner images KI, CI, MI, and YI. There is a tendency that when a print image composed of the deformed toner images KI, CI, MI, and YI is viewed by human eyes, jaggy of cyan, magenta, and yellow is unnoticeable, but jaggy of black is significantly noticeable compared to the other colors.

In the color printer 1, for each of the toner images KI, CI, MI, and YI, a distortion amount (also referred to below as an image distortion amount) representing the amount of image distortion of the toner image is obtained or measured in advance for each block BL through an experiment or the like. As described above, at the secondary transfer position, the image distortions occur in the toner images KI, CI, MI, and YI so that the entire images deform substantially uniformly. Thus, the image distortion amount for each block BL of each toner image is obtained with respect to the first line LN, for example. The image distortion amount for each block BL of each toner image represents the amount of image distortion with a distance and a direction of displacement of the block BL from an original formation position due to deformation of the entire image, for example. The original formation position is a position at which the block BL is formed if the toner image has no image distortion.

Figure 10:
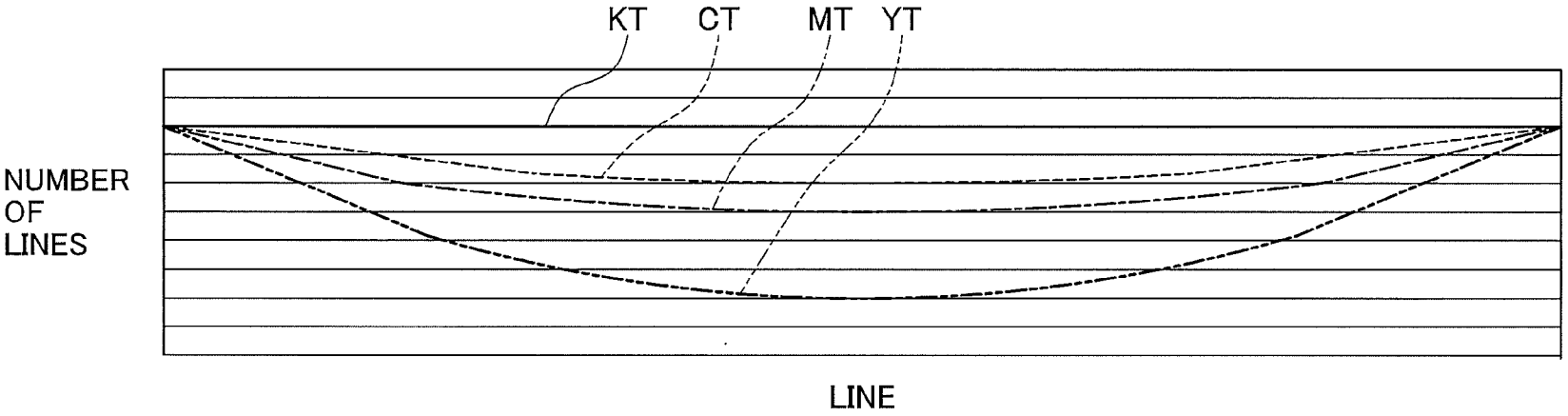
FIG. 10 is a schematic graph for explaining deformation amounts obtained from the image distortions of the toner images of four colors.

As shown in FIG. 10, in the color printer 1, for the toner images KI, CI, MI, and YI, deformation amounts KT, CT, MT, and YT are obtained for each block BL, respectively. The deformation amounts serve as correction values for compensating the image distortions. The deformation amount for each block BL of each toner image is obtained by calculating the difference between the image distortion amount of the block BL and the image distortion amount of the corresponding block (also referred to below as the corresponding block) BL of black, for example. The deformation amount is used for deforming the corresponding toner image in the image vertical direction in advance and represents the amount of deformation of the toner image. Specifically, the deformation amounts KT, CT, MT, and YT for the blocks BL of the toner images KI, CI, MI, and YI are respectively used for deforming the toner images KI, CI, MI, and YI (or electrostatic latent images EI) in the image vertical direction in advance so that the shapes of the toner images KI, CI, MI, and YI match that of the toner image KI at the secondary transfer position. That is, the toner images KI, CI, MI, and YI are deformed in advance with the shape of the black toner image KI at the secondary transfer position as a reference.

Each of the deformation amounts KT, CT, MT, and YT for the blocks BL of the toner images KI, CI, MI, and YI represents the amount of deformation, including whether the deformation is performed, with a distance and a direction from an original formation position of the block BL to a formation position for deformation of the block BL; the original formation position is a position at which the block BL is formed if the deformation is not performed; the formation position for deformation is a position at which the block BL is formed if the deformation is performed.

In the color printer 1, the shape of the black toner image KI having the image distortion is used as a reference for deforming the other cyan, magenta, and yellow toner images CI, MI, and YI; the black toner image KI is not deformed in advance. Thus, the deformation amount KT for each block BL of the black toner image KI is generated to represent that the block BL is not deformed or displaced and is formed at the original formation position, with a value '0', for example.

The deformation amount CT for each block BL of the cyan toner image CI is generated as follows. When the block BL matches the corresponding block BL of black at the secondary transfer position even if the block BL is formed at the original formation position, the deformation amount CT is generated to represent that the block BL is not deformed or displaced and is formed at the original formation position, with a value '0', for example. When the block BL matches the corresponding block BL of black at the secondary transfer position if the block BL is formed at a formation position for deformation displaced form the original formation position, the deformation amount CT is generated to represent that the block BL is displaced from the original formation position, with the number of lines indicating a distance from the original formation position to the formation position for deformation and a sign indicating a direction from the original formation position to the formation position for deformation. The deformation amounts MT and YT for the respective blocks BL of the toner images MI and YI are generated in the same way as the deformation amounts CT.

As shown in FIG. 2, the printer controller 55 includes a deformation amount storage unit 73 that is a nonvolatile memory such as a flash memory. The deformation amounts KT, CT, MT, and YT for the respective block BL of the toner images KI, CI, MI, and YI are stored in the deformation amount storage unit 73 in advance.

The above described line inclination and line distortion occurring in each of the toner images KI, CI, MI, and YI are so small that they are almost unperceivable when a print image composed of a toner image of single color is viewed by human eyes, for example. However, the color shift in the image vertical direction caused by superposing the four color toner images KI, CI, MI, and YI having the line inclinations and line distortions can easily be perceived on the print image, similarly to the color shift caused by the image distortions.

Such a color shift may be reduced or removed by forming the toner images KI, CI, MI, and YI (specifically, by correcting the print image data or head control data) so as to compensate or cancel the difference in the line inclination and line distortion among the toner images KI, CI, MI, and YI. Thus, when forming the electrostatic latent images EI, the main controller 60 appropriately corrects the line inclinations and line distortions by the block BL so as to cancel the difference in the line inclination and line distortion among the toner images KI, CI, MI, and YI.

Regarding correction of such a color shift, for the same reason as that in the case of correcting the color shift caused by the image distortion, the main controller 60 appropriately corrects the line inclinations and line distortions of the cyan, magenta, and yellow toner images CI, MI, and YI with the line inclination and line distortion of the black toner image KI as a reference.

In the initial setting of the color printer 1 or upon receipt of an instruction of color shift correction from a user via the operation panel 3, the main controller 60 appropriately controls respective units to execute a correction value setting process to set correction values (also referred to below as color shift correction values) for correcting the color shifts due to the line inclinations, line distortions, and image distortions.

At this time, the image forming controller 61 controls the image forming mechanism 69 to drive respective units in the four image forming units 10 to 13 other than the exposure heads 25 to 28 and respective units in the transfer unit 15 other than the secondary transfer roller 41, as in the case of formation of a print image.

The color shift detector 67 generates, by the line LN, head control data for forming toner images (also referred to below as color shift detection images) for detecting the amounts of color shift due to the line inclination and transmits the generated head control data to the head controllers 63 to 66. The color shift detection images have a predetermined pattern such as a stripe arranged in the image vertical direction. Hereinafter, for each color, head control data for multiple lines for forming the entire color shift detection image will be also referred to as detection image formation control data.

For example, the color shift detector 67 controls intervals at which the head controller 63 corresponding to black transmits the detection image formation control data so as to form a predetermined number of color shift detection images; the color shift detector 67 also controls intervals at which the head controller 64 corresponding to cyan transmits the detection image formation control data so as to form a predetermined number of color shift detection images. Thus, the color shift detector 67 causes the head controllers 63 and 64 to sequentially transmit the respective detection image formation control data to the respective exposure heads 25 and 26 while maintaining the configuration of the detection image formation control data.

While the black image forming unit 10 forms an electrostatic latent image on the drum surface of the photosensitive drum 20 by the exposure head 25 based on the detection image formation control data, it develops the electrostatic latent image with the toner to sequentially form the predetermined number of color shift detection images of black at equal intervals.

While the cyan image forming unit 11 forms an electrostatic latent image on the drum surface of the photosensitive drum 21 by the exposure head 26 based on the detection image formation control data, it develops the electrostatic latent image with the toner to sequentially form the predetermined number of color shift detection images of cyan at equal intervals different from those of the black color shift detection images by a line LN.

While the transfer unit 15 sequentially transfers the predetermined number of black color shift detection images and the predetermined number of cyan color shift detection images formed by the image forming units 10 and 11 onto the belt surface of the transfer belt 36 so that the black color shift detection images are superposed on the corresponding cyan color shift detection images one by one to form the predetermined number of sets of the black and cyan color shift detection images along the belt conveying direction, the transfer unit 15 conveys the transferred color shift detection images by the transfer belt 36 to the left and right color shift sensors 71 and 72 side.

The color shift detector 67 drives the left and right color shift sensors 71 and 72. Each of the color shift sensors 71 and 72 emits detection light from the light emitting element and receives by the light receiving element reflection light obtained by reflection of the detection light from the belt surface to transmit a reception light signal having a level corresponding to the intensity of the reflection light to the color shift detector 67.

If the transferred black color shift detection images and the cyan color shift detection images have no line inclination or the same line inclination, they have the following positional relationship on the belt surface: at an intended set (e.g., central set) of the predetermined number of sets, the black color shift detection image and the cyan color shift detection image match each other; at each of the other sets on the belt conveying direction upstream side and belt conveying direction downstream side of the intended set, the black color shift detection image and the cyan color shift detection image are displaced from each other by an amount that increases by a line LN as the set separates from the intended set.

However, if the transferred black color shift detection images and the cyan color shift detection images have different line inclinations, they have the following positional relationship on the belt surface: at one of the predetermined number of sets other than the intended set, the black color shift detection image and the cyan color shift detection image match each other; at each of the other sets, the black color shift detection image and the cyan color shift detection image are displaced from each other by an amount corresponding to one or more lines, the number of which is different from an intended number.

The belt surface of the transfer belt 36, toners of cyan, magenta, and yellow, and toner of black are different in reflectance. While the color shift detector 67 monitors the level of the reception light signal supplied from the left color shift sensor 71, it determines, based on the variation of the level, from among the predetermined number of sets, a set (also referred to below as the matched set) in which the black color shift detection image and the cyan color shift detection image match each other at a position (also referred to below as the left sensor facing position) facing the left color shift sensor 71 on the belt surface. The color shift detector 67 also determines a position (also referred to below as the matched set position) of the matched set in the sequence of the predetermined number of sets.

Based on the results of the determination, the color shift detector 67 detects the presence or absence and the amount of color shift of the cyan color shift detection image relative to the black color shift detection image at the left sensor facing position. In accordance with the presence or absence and the amount of color shift, the color shift detector 67 generates a correction value (also referred to below as a left position block shift correction value) for correcting a formation position of a block (also referred to below as the left position block) BL at the left sensor facing position in the cyan color shift detection image so as to match a formation position of the corresponding block (also referred to below as the corresponding left position block) BL in the black color shift detection image.

Specifically, if the determined matched set is the intended set, the color shift detector 67 determines that the cyan color shift detection image is not shifted (color-shifted) from the black color shift detection image at the left sensor facing position. Then, the color shift detector 67 generates a left position block shift correction value representing a positional relationship (i.e., coincidence) between an original formation position of the left position block BL and a formation position for correction of the left position block BL (in this case, formation position of the left position block BL), with a value '0', for example. The original formation position is a position at which the left position block BL is formed if the correction is not performed; the formation position for correction is a position at which the left position block BL is formed if the correction is performed.

In contrast, if the determined matched set is not the intended set, the color shift detector 67 determines that the cyan color shift detection image is shifted (color-shifted) from the black color shift detection image at the left sensor facing position by the distance corresponding to the determined matched set position. Then, the color shift detector 67 generates a left position block shift correction value representing a positional relationship between the original formation position of the left position block BL and a formation position for correction of the left position block BL (in this case, formation position of the corresponding left position block BL), with the number of lines indicating the distance for displacing the formation position of the cyan left position block BL to the formation position of the black corresponding left position block BL and a sign indicating the direction of the displacement, for example.

Similarly, while the color shift detector 67 monitors the level of the reception light signal supplied from the right color shift sensor 72, it determines, based on the variation of the level, a matched set and a matched set position at a position (also referred to below as the right sensor facing position) facing the right color shift sensor 72 on the belt surface. Based on the results of the determination, the color shift detector 67 detects the presence or absence and the amount of color shift of the cyan color shift detection image relative to the black color shift detection image at the right sensor facing position.

As in the case of generating the left position block shift correction value, in accordance with the presence or absence and the amount of color shift at the right sensor facing position, the color shift detector 67 generates a correction value (also referred to below as a right position block shift correction value) for correcting a formation position of a block (also referred to below as the right position block) BL at the right sensor facing position in the cyan color shift detection image so as to match a formation position of the corresponding block (also referred to below as the corresponding right position block) BL in the black color shift detection image.

When the color shift detector 67 generates the left position block shift correction value and right position block shift correction value for cyan with the black color shift detection image as a reference, it transmits and stores the left position block shift correction value and right position block shift correction value into a correction value storage unit 74, which is a nonvolatile memory, such as an EEPROM, provided in the printer controller 55.

Then, in the same manner as described above, the color shift detector 67 controls the head controllers 63 and 65 corresponding to black and magenta to execute a series of processes. Thus, the color shift detector 67 generates a left position block shift correction value and right position block shift correction value for magenta with the black color shift detection image as a reference, and stores them into the correction value storage unit 74.

Then, in the same manner as described above, the color shift detector 67 controls the head controllers 63 and 66 corresponding to black and yellow to execute a series of processes. Thus, the color shift detector 67 generates a left position block shift correction value and right position block shift correction value for yellow with the black color shift detection image as a reference, and stores them into the correction value storage unit 74.

Upon completion of storing the left position block shift correction values and right position block shift correction values for the three colors (cyan, magenta, and yellow) in the correction value storage unit 74, the color shift detector 67 notifies the main controller 60 of it. Upon receiving this notification from the color shift detector 67, the main controller 60 instructs the inclination correction value generator 68 to generate inclination correction values for correcting the line inclinations.

Upon receiving the instruction from the main controller 60, the inclination correction value generator 68 generates inclination correction value for each block BL in a line LN of the black toner image KI. As described above, the line inclination of the black toner image KI is used as a reference for correcting the line inclinations of the toner images CI, MI, and YI of cyan, magenta, and yellow. Thus, the inclination correction value generator 68 generates the inclination correction value for each block BL of the black toner image KI to represent that the block BL is not subjected to the line inclination correction and is formed at the original formation position, with a value '0', for example.

The inclination correction value generator 68 reads, from the correction value storage unit 74, the left position block shift correction value and right position block shift correction value for cyan as the inclination correction values for the left position block BL and right position block BL on a line LN. Then, based on the inclination correction values for the left position block BL and right position block BL, the inclination correction value generator 68 obtains the inclination correction values for the respective blocks BL constituting a line LN other than the left position block BL and right position block BL by interpolation or other similar methods, for example.

In this way, the inclination correction value generator 68 generates the inclination correction values (i.e., inclination correction values for a line LN including the left position block BL and right position block BL) for the respective blocks BL of the cyan toner image CI with the line inclination of the black toner image KI as a reference. The inclination correction value generator 68 generates the inclination correction value for each block BL of the cyan toner image CI to represent a positional relationship between the original formation position of the block BL and the formation position for correction of the block BL with a distance indicated by the number of lines LN and a direction indicated by a sign.

For each of magenta and yellow, the inclination correction value generator 68 also reads, from the correction value storage unit 74, the left position block shift correction value and right position block shift correction value as the inclination correction values for the left position block BL and right position block BL on a line LN. As in the case of cyan, for each of magenta and yellow, the inclination correction value generator 68 generates, based on the inclination correction values for the left position block BL and right position block BL, the inclination correction values (i.e., inclination correction values for a line LN including the left position block BL and right position block BL) for the respective blocks BL of the toner image.

When the inclination correction value generator 68 generates the inclination correction value for each block BL for each of the toner images KI, CI, MI, and YI, it transmits these inclination correction values to a distortion correction value combiner 75 and instructs the distortion correction value combiner 75 to combine the inclination correction values with distortion correction values for correcting the line distortions.

Meanwhile, when the main controller 60 starts the correction value setting process, it causes a head information reader 76 to read the above described head information from each of the exposure heads 25 to 28 and hold the read information. When the distortion correction value combiner 75 receives from the inclination correction value generator 68 the instruction to combine the inclination correction values with distortion correction values, it reads the four types of head information from the head information reader 76.

As described above, the head distortion of each of the exposure heads 25 to 28 deforms a line LN of the corresponding electrostatic latent image EI or toner image KI, CI, MI, or YI similarly to the head distortion; the head distortion has the displacement of the LEDs by the LED array and causes the displacement of the toner image by the block BL. Thus, the head information of each of the exposure heads 25 to 28 represents the line distortion occurring in a line LN of the corresponding electrostatic latent image EI or toner image; the head distortion amount for each LED array indicated by the head information represents the displacement of the corresponding block BL of the electrostatic latent image EI or toner image.

The distortion correction value combiner 75 obtains a distortion correction value for each block BL of the toner images KI, CI, MI, and YI with the line distortion of the black toner image KI as a reference, by calculating the difference between the head distortion amount for each LED array of each of the exposure heads 25 to 28 indicated by the four types of head information and the head distortion amount for the corresponding LED array of the black exposure head 25 indicated by one of the four types of head information, for example.

As described above, the line distortion of the black toner image KI is used as a reference for correcting the line distortions of the cyan, magenta, and yellow toner images CI, MI, and YI. Thus, the distortion correction value combiner 75 generates, by the calculation using the head distortion amounts, the distortion correction value for each block BL of the black toner image KI to represent that the block BL is not subjected to the line distortion correction and is formed at the original formation position, with a value '0', for example.

The distortion correction value combiner 75 generates the distortion correction value for each block BL of each of the toner images CI, MI, and YI to represent a positional relationship between an original formation position of the block BL and a formation position for correction of the block BL with a distance indicated by the number of lines LN and a direction indicated by a sign. The original formation position is a position at which the block BL is formed if the correction is not performed; the formation position for correction is a position at which the block BL is formed if the correction is performed.

For each block BL of the black toner image KI, the distortion correction value combiner 75 combines (or adds up) the inclination correction value and distortion correction value corresponding to the block BL to generate an inclination distortion correction value, which includes a component for correcting the line inclination and a component for correcting the line distortion.

Similarly, for each block BL of the toner images CI, MI, and YI, the distortion correction value combiner 75 combines (or adds up) the inclination correction value and distortion correction value corresponding to the block BL to generate an inclination distortion correction value.

When the distortion correction value combiner 75 generates the inclination distortion correction value for each block BL of the toner images KI, CI, MI, and YI, it transmits them to a deformation amount combiner 77 and instructs the deformation amount combiner 77 to combine the inclination distortion correction values with the above described deformation amounts KT, CT, MT, and YT.

When the deformation amount combiner 77 receives from the distortion correction value combiner 75 the instruction to combine the inclination distortion correction values with the deformation amounts KT, CT, MT, and YT, it reads the deformation amounts KT, CT, MT, and YT for the respective blocks BL of the toner images KI, CI, MI, and YI from the deformation amount storage unit 73. For each block BL of the black toner image KI, the deformation amount combiner 77 combines (or adds up) the inclination distortion correction value and deformation amount KT corresponding to the block BL to generate a color shift correction value.

Similarly, for each block BL of the toner images CI, MI, and YI, the deformation amount combiner 77 combines (or adds up) the inclination distortion correction value and deformation amount CT, MT, or YT corresponding to the block BL to generate a color shift correction value. As described above, each of the deformation amounts KT of the black toner image KI indicates, for example, a value '0'. Thus, the deformation amount combiner 77 also generates the color shift correction value for each block BL of the toner image KI to represent that the block BL is formed at the original formation position with a value '0'.

The color shift correction value for each block BL of the toner images KI, CI, MI, and YI includes a component for correcting the line inclination, a component for correcting the line distortion, and a component for deforming the entire image. Specifically, the color shift correction value for each block BL of the toner images KI, CI, MI, and YI includes: a correction component for appropriately correcting the line inclination of the toner image KI, CI, MI, or YI with the line inclination of the toner image KI as a reference; a correction component for appropriately correcting the line distortion of the toner image KI, CI, MI, or YI with the line distortion of the toner image KI as a reference; and a deformation component for appropriately deforming the entire image so as to cancel or compensate the difference in the image distortion among the toner images KI, CI, MI, and YI with the image distortion of the black toner image KI as a reference.

The color shift correction value for each block BL of the toner images KI, CI, MI, and YI represents the correction component for the line inclination, the correction component for the line distortion, and the deformation component for the entire image, with a distance and a direction from an original formation position of the block BL to a formation position for color shift correction of the block BL. The original formation position is a position at which the block BL is formed if the correction is not performed; the formation position for color shift correction is a position at which the block BL is formed if the correction is performed (or the block BL is to be formed so as to correct the color shift in accordance with the line inclination, line distortion, and deformation amounts KT, CT, MT, and YT). The color shift correction value for each block BL indicates the distance with the number of lines and indicates the direction with a sign. The number of lines and sign indicated by the color shift correction value for each block BL is used to control the timing for transmitting the corresponding data block of the head control data so as to form the block BL at the formation position for color shift correction; the timing is delayed or advanced according to the sign by the number of lines.

As described later, during formation of a print image, each of the head controllers 63 to 66 uses the color shift correction value for each block BL to control the timing for transmitting each data block constituting the head control data. In order to allow each of the head controllers 63 to 66 to perform the control of the transmission timing of the data blocks more smoothly, for each of the toner images KI, CI, MI, and YI, the deformation amount combiner 77 determines the greatest (also referred to below as the delay greatest line number) of the numbers of lines by which the timings for transmitting the data blocks are delayed, based on the number of lines and sign indicated by the color shift correction value for each block BL.

When the deformation amount combiner 77 obtains the color shift correction value for each block BL of the toner images KI, CI, MI, and YI and the delay greatest line number for each of the toner images KI, CI, MI, and YI, it transmits them to the corresponding head controllers 63 to 66 and causes the head controllers 63 to 66 to hold them. Then, the main controller 60 ends the correction value setting process.

Figure 11:
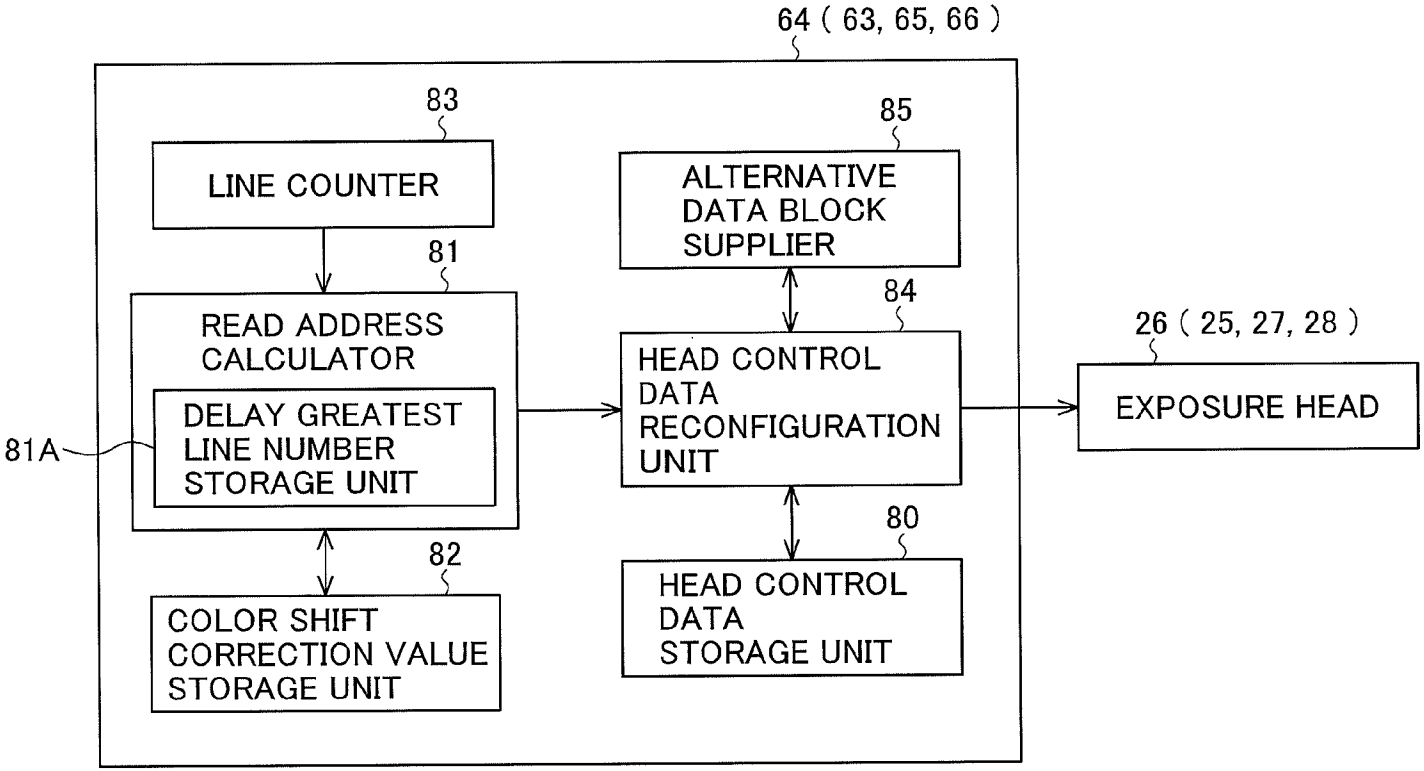
FIG. 11 is a block diagram showing a circuit configuration of a head controller.

Next, the circuit configuration of each of the head controllers 63 to 66 will be described with reference to FIG. 11. The head controllers 63 to 66 have the same configuration, so the following description will specifically describe the circuit configuration of the head controller 64 for the exposure head 26 corresponding to cyan, and will complementally describe the circuit configurations of the other head controllers 63, 65, and 66, focusing on differences from that of the head controller 64.

The head controller 64 includes a head control data storage unit 80, such as a RAM (Random Access Memory), for storing head control data for multiple lines LN for forming the cyan toner image CI by the data block. The head controller 64 further includes a read address calculator 81 that individually calculates read addresses for the plurality of data blocks in the head control data storage unit 80; the read address calculator 81 includes a delay greatest line number storage unit 81A such as a register. The head controller 64 further includes a color shift correction value storage unit 82, such as a RAM, for storing the color shift correction value for each block BL of the cyan toner image CI.

Figure 12:
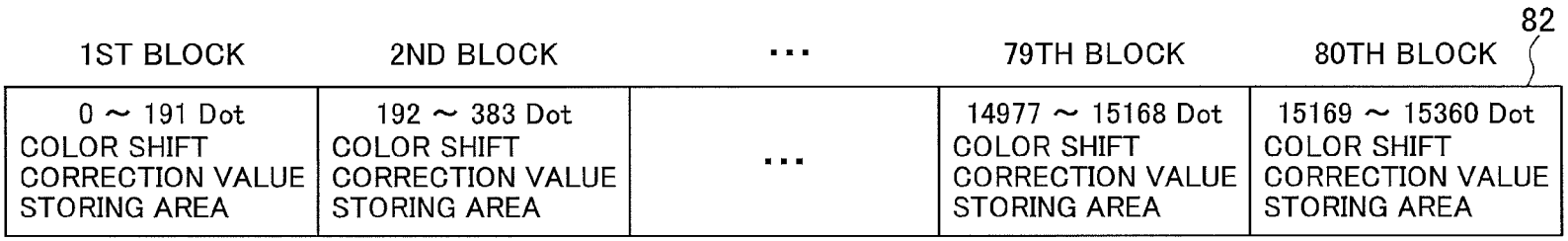
FIG. 12 is a schematic diagram for explaining storage of color shift correction values in a color shift correction value storage unit.

In the correction value setting process, upon receiving the color shift correction value for each block BL of the cyan toner image CI from the deformation amount combiner 77, the head controller 64 sequentially stores the color shift correction value for each block BL into the color shift correction value storage unit 82 as shown in FIG. 12; upon receiving the delay greatest line number for the cyan toner image CI from the deformation amount combiner 77, the head controller 64 (FIG. 11) stores it into the delay greatest line number storage unit 81A by the read address calculator 81.

In formation of a print image, when the head controller 64 receives the head control data for multiple lines LN for forming the cyan toner image CI from the main controller 60, it sequentially stores the head control data for multiple lines LN into the head control data storage unit 80 by the data block, as shown in FIG. 13. Then, the head controller 64 (FIG. 11) starts the control of the corresponding exposure head 26 under the instruction of the main controller 60.

At this time, a line counter 83 in the head controller 64 counts a line number indicating a line LN to be formed in the electrostatic latent image EI by sequentially incrementing the line number by one at predetermined time intervals, and notifies the read address calculator 81 of the counted line number. Each time the read address calculator 81 is notified of the line number from the line counter 83, it sequentially calculates the read addresses for the data blocks constituting head control data for a line LN in the head control data storage unit 80.

The read address for a data block in the head control data storage unit 80 is indicated by a line number and a block number; the read address calculator 81 changes the block number indicated by the read address in order (specifically, so that the block number indicates the 1st to 80th blocks BL in turn).

Each time the read address calculator 81 changes the block number indicated by the read address, it calculates the line number indicated by the read address based on the color shift correction value for the block BL corresponding to the block number in the color shift correction value storage unit 82, the line number notified from the line counter 83, and the delay greatest line number in the delay greatest line number storage unit 81A. Hereinafter, the line number notified from the line counter 83 will be also referred to as the notified line number.

Specifically, each time the read address calculator 81 sequentially changes the block number indicated by the read address, it calculates the line number according to the following equation (1):

$$AL=NL-DL+CL \quad (1),$$

where AL is the line number to be calculated of the read address, NL is the notified line number, DL is the delay greatest line number, and CL is the color shift correction value (i.e., the number of lines with the sign) corresponding to the block number indicated by the read address. That is, the read address calculator 81 calculates the line number by subtracting the delay greatest line number from the notified line number and adding the color shift correction value to the subtraction result.

The calculated line number may be less than, equal to, or greater than '0'. In any of these cases, the read address calculator 81 transmits the read address indicating both the calculated line number and the block number to a head control data reconfiguration unit 84.

When the head control data reconfiguration unit 84 receives the read address from the read address calculator 81, if the line number indicated by the read address is greater than or equal to '0', the head control data reconfiguration unit 84 reads the data block in a data block storing area assigned with the line number and block number indicated by the read address from the head control data storage unit 80.

If the line number indicated by the read address supplied from the read address calculator 81 is less than '0', the head control data reconfiguration unit 84 acquires an alternative data block for halting the drive of the LED array (i.e., 192 LEDs) from an alternative data block supplier 85.

The alternative data block supplier 85 may be configured to, each time receiving a request for an alternative data block from the head control data reconfiguration unit 84, generate an alternative data block to supply it, or may be configured to store an alternative data block in advance and each time receiving a request for an alternative data block from the head control data reconfiguration unit 84, supply the stored alternative data block.

Each time the head control data reconfiguration unit 84 receives the read address from the read address calculator 81, it performs the above process. The head control data reconfiguration unit 84 arranges the data blocks and alternative data blocks obtained from the head control data storage unit 80 and alternative data block supplier 85 in the order of the block numbers indicated by the corresponding read addresses to reconfigure the head control data, transmitting the reconfigured head control data to the corresponding exposure head 26.

In this way, the head controller 64 can individually control the timings for transmitting the data blocks constituting the head control data for each line LN by calculating the read address using the color shift correction values by the read address calculator 81, and reconfigure the head control data for each line LN by combining the data blocks constituting the head control data, data blocks constituting the head control data of other lines LN, and alternative data blocks, sequentially transmitting them to the exposure head 26.

In the head controller 63 for the exposure head 25 corresponding to black, the color shift correction value for each block BL stored in the color shift correction value storage unit 82 indicates a value '0', and the delay greatest line number stored in the delay greatest line number storage unit 81A also indicates a value '0'.

Thus, in the head controller 63, although the read address calculator 81 calculates the line numbers according to the above equation (1) each time it receives the notified line number from the line counter 83, each of the calculated line number is equal to the notified line number. Thus, in the head controller 63, each time the read address calculator 81 receives the notified line number from the line counter 83, it sequentially transmits, to the head control data reconfiguration unit 84, read addresses each indicating the notified line number while changing the block number indicated by the read address in order.

Therefore, in the head controller 63, the head control data reconfiguration unit 84 sequentially reads all the data blocks constituting the head control data for a line LN from the head control data storage unit 80 in accordance with the read addresses, so that it transmits the head control data to the corresponding exposure head 25 without reconfiguration of the head control data (i.e., while maintaining the configuration of the head control data supplied from the main controller 60).

The exposure head 25 corresponding to black uses the head control data generated by the main controller 60 as they are to illuminate the drum surface of the photosensitive drum 20, thereby forming the electrostatic latent image EI line LN by line LN on the drum surface without correction of the line inclination, correction of the line distortion, and deformation in response to the image distortion.

The main controller 60 causes the black image forming unit 10 to develop the electrostatic latent image EI formed by the exposure head 25 to form a black toner image KI on the drum surface of the photosensitive drum 20 without correction of the line inclination, correction of the line distortion, and deformation in response to the image distortion.

In contrast, the exposure heads 26 to 28 corresponding to cyan, magenta, and yellow illuminate the drum surfaces of the photosensitive drums 21 to 23 by using head control data reconfigured by appropriately controlling the transmission timings of the data blocks by the head controllers 64 to 66. Each of the exposure heads 26 to 28 forms an electrostatic latent image EI line LN by line LN on the drum surface while correcting the line inclination and line distortion so as to match those of the black toner image KI and deforming in advance the electrostatic latent image EI with the shape of the toner image KI having the image distortion as a reference.

Thus, the main controller 60 causes the image forming units 11 to 13 corresponding to cyan, magenta, and yellow to develop the electrostatic latent images EI formed by the exposure heads 26 to 28 to form cyan, magenta, and yellow toner images CI, MI, and YI on the drum surfaces of the photosensitive drums 21 to 23 while correcting the line inclinations and line distortions so as to match those of the black toner image KI and deforming in advance the electrostatic latent images EI in accordance with the image distortion occurring in the toner image KI at the secondary transfer position.

Figure 14:
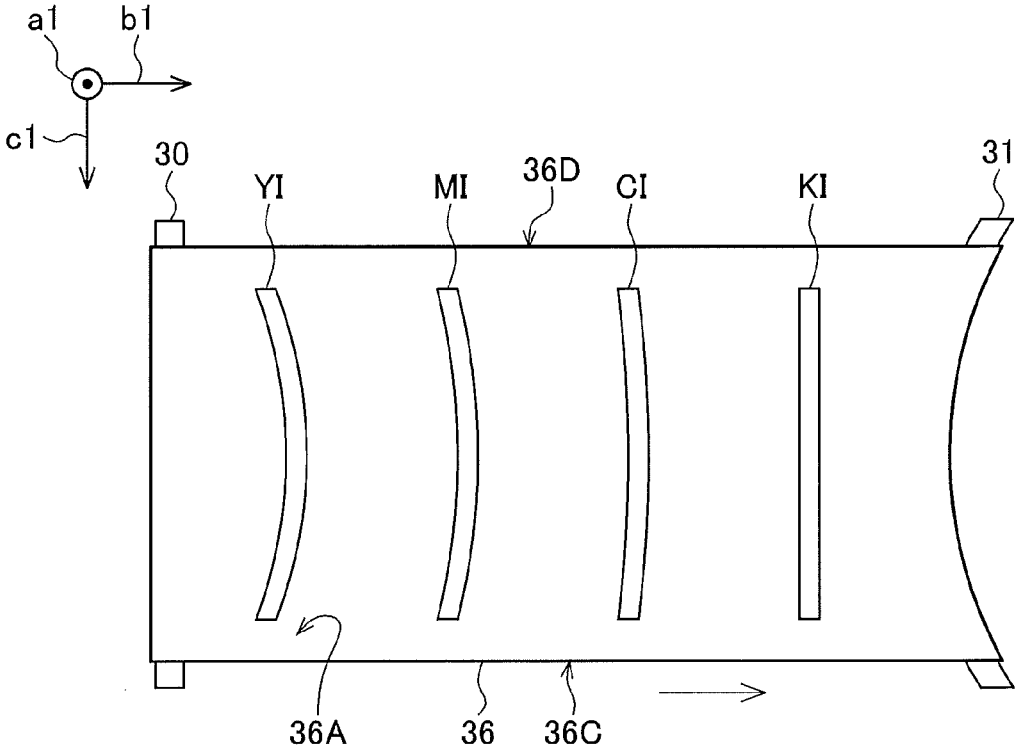
FIG. 14 is a schematic top view for explaining transfer of cyan, magenta, and yellow toner images formed while being deformed in advance onto the belt surface of the transfer belt.

As shown in FIG. 14, the main controller 60 causes the transfer unit 15 to sequentially transfer the toner images KI, CI, MI, and YI onto the belt surface of the transfer belt 36 in a superposed manner.

Figure 15:
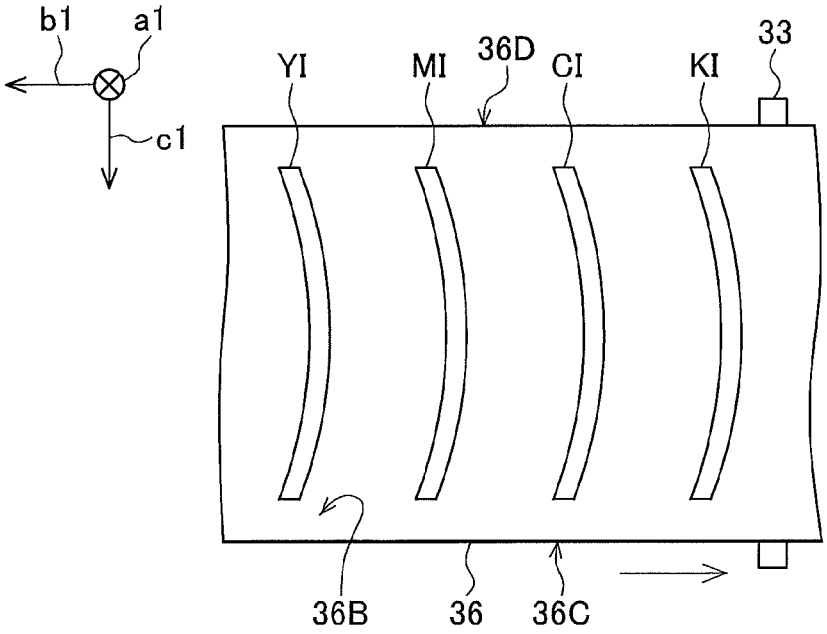
FIG. 15 is a schematic bottom view for explaining that the shapes of the toner images of four colors match at the secondary transfer position on the belt surface of the transfer belt.

As shown in FIG. 15, while the transfer unit 15 conveys the toner images KI, CI, MI, and YI on the belt surface from the respective primary transfer positions to the secondary transfer position by the rotation of the transfer belt 36, the belt distortion of the image transferred portion changes by different amounts among the four colors, and image distortions occur in the toner images KI, CI, MI, and YI.

However, since the main controller 60 has formed the toner images CI, MI, and YI while deforming them in advance, the shapes of the toner images KI, CI, MI, and YI can be substantially matched with each other at the secondary transfer position on the belt surface of the transfer belt 36. Thus, the main controller 60 can prevent a color shift in the image vertical direction from occurring in the toner images KI, CI, MI, and YI at the secondary transfer position on the belt surface, and form a print image by transferring the toner images onto the surface of the recording paper 5 as they are.

(1-3) Operation and Advantage of First Embodiment

In the above configuration of the color printer 1, the four image forming units 10 to 13 are arranged along the belt conveying direction in order on the belt conveying direction upstream side of the tension roller stretched part of the belt surface so as to face the belt surface. The color printer 1 stores, in the printer controller 55, the different deformation amounts KT, CT, MT, and YT for the toner images KI, CI, MI, and YI corresponding to the different image distortions occurring in the toner images KI, CI, MI, and YI.

In formation of a print image, the color printer 1 controls the image forming units 10 to 13 by the printer controller 55 based on the deformation amounts KT, CT, MT, and YT to form the toner images KI, CI, MI, and YI while appropriately deforming them in advance, sequentially transfers and superposes the toner images KI, CI, MI, and YI on the belt surface of the transfer belt 36, and conveys them to the secondary transfer position.

Thus, while the color printer 1 conveys the toner images KI, CI, MI, and YI on the belt surface from the respective primary transfer positions to the secondary transfer position, even if the belt distortion changes by different amounts among the four colors and image distortions occur in the toner images KI, CI, MI, and YI, the color printer 1 can substantially match the shapes of the toner images KI, CI, MI, and YI and almost certainly prevent the occurrence of a color shift.

With the above configuration, the color printer 1 stores, in the printer controller 55, the different deformation amounts KT, CT, MT, and YT for the toner images KI, CI, MI, and YI corresponding to the different image distortions occurring in the toner images KI, CI, MI, and YI conveyed to the secondary transfer position by the transfer belt 36; in formation of a print image, by the printer controller 55, the color printer 1 controls the image forming units 10 to 13 based on the deformation amounts KT, CT, MT, and YT to form the toner images KI, CI, MI, and YI while appropriately deforming them in advance, and sequentially transfers and superposes the toner images KI, CI, MI, and YI on the belt surface of the transfer belt 36, conveying them to the secondary transfer position.

Thus, while the color printer 1 conveys the toner images KI, CI, MI, and YI by the transfer belt 36 from the respective primary transfer positions to the secondary transfer position, even if the belt distortion of the image transferred portion changes by different amounts among the four colors, the color printer 1 can substantially match the shapes of the toner images KI, CI, MI, and YI and almost certainly prevent the occurrence of a color shift. Therefore, the color printer 1 can reduce the deterioration of a print image formed on a surface of a recording paper 5 based on the toner images KI, CI, MI, and YI.

Further, in the color printer 1, the deformation amounts KT for the black toner image KI are generated to represent that no deformation is applied to the black toner image KI, and based on the deformation amounts KT, the black toner image KI is formed by the image forming unit 10 without prior deformation. On the other hand, the deformation amounts CT, MT, and YT for the cyan, magenta, and yellow toner images CI, MI, and YI are generated to represent that different deformations are applied to the toner images CI, MI, and YI with the deformation amounts KT for the black toner image KI as a reference, and based on the deformation amounts CT, MT, and YT, the cyan, magenta, and yellow toner images CI, MI, and YI are formed by the image forming units 11 to 13 with prior deformations. Thus, when forming the black toner image KI by the image forming unit 10, the color printer 1 can prevent the occurrence of jaggy in a continuous line in a picture.

Further, in the color printer 1, the head control data for forming the toner images KI, CI, MI, and YI are divided into the plurality of data blocks, and in formation of the print image, based on the deformation amounts KT, CT, MT, and YT, the printer controller 55 controls, by the data block, the timings for transmitting the head control data to the respective image forming units 10 to 13. Thus, the color printer 1 can form the toner images KI, CI, MI, and YI by the respective image forming units 10 to 13 while appropriately deforming the toner images.

Further, for each of the toner images KI, CI, MI, and YI, the color printer 1 combines the inclination correction values for correcting the line inclination of the toner image and the distortion correction values for correcting the line distortion of the toner image with the deformation amounts to generate color shift correction values. Then, the color printer 1 controls the timings for transmitting the head control data to the respective image forming units 10 to 13 based on the color shift correction values by the data block, and forms the toner images KI, CI, MI, and YI by the respective image forming units 10 to 13. Thus, the color printer 1 can form the toner images KI, CI, MI, and YI by the image forming units 10 to 13 while simultaneously applying the corrections of the line inclinations, the corrections of the line distortions, and deformations according to the deformation amounts KT, CT, MT, and YT to the toner images.

(2) Second Embodiment (2-1) Configuration of Color Printer

Figure 16:
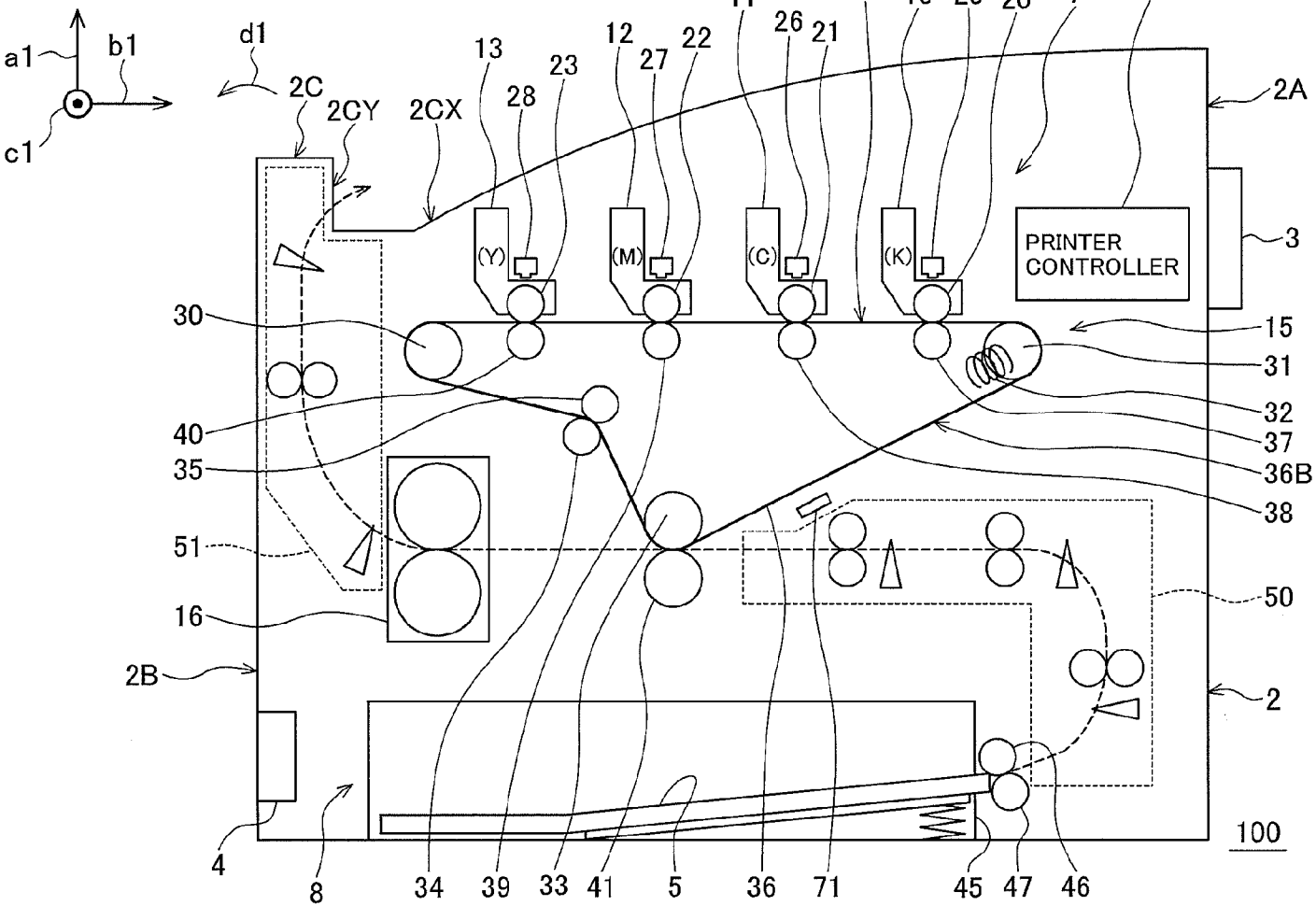
FIG. 16 is a schematic side view showing a configuration of a color printer in a second embodiment.

Next, the configuration of a color printer 100 in the second embodiment will be described with reference to FIG. 16, in which parts that are the same as or correspond to those in FIG. 1 have the same reference characters. The color printer 100 in the second embodiment has the same configuration as that of the color printer 1 in the first embodiment except for the configuration of a printer controller 101 and the addition of a color shift sensor having the same structure as those of the left color shift sensor 71 and right color shift sensor 72.

In the color printer 100, for example, due to variation of ambient temperature or aging variations of the tension roller 31 and transfer belt 36, the amount of deflection occurring in the tension roller 31 and the amount of belt distortion occurring in the transfer belt 36 may change relative to those at the time of manufacture of the color printer 100. When the amount of belt distortion occurring in the transfer belt 36 changes, the amounts of image distortion occurring in the toner images KI, CI, MI, and YI at the secondary transfer position may also change relative to the amounts of image distortion obtained in advance as described above.

As described above, the tension roller 31 is continuously urged forward by the pair of compression coil springs 32 with relatively large urging force at the left end part and the right end part of the roller rotation shaft. Thus, regarding the tension roller 31, the amount of deflection does not change very much at each end, and changes more greatly toward the center.

Regarding the transfer belt 36, in accordance with the change in the amount of deflection occurring in the tension roller 31, the amount of belt distortion does not change very much near the belt left opening 36C and belt right opening 36D, and changes more greatly toward the center in the belt width direction.

Regarding the toner images KI, CI, MI, and YI transferred on the belt surface of the transfer belt 36 in a superposed manner, in accordance with the change in the amount of belt distortion occurring in the transfer belt 36, the amount of image distortion does not change very much at each end in the image horizontal direction, and changes more greatly toward the center in the image horizontal direction.

When the deflection of the tension roller 31 changes, the direction of deflection does not change and only the degree of deflection (i.e., depth) in the arcuate shape changes. Thus, when the belt distortion of the transfer belt 36 changes, the direction of distortion in the arcuate shape does not change, and only the degree of distortion (i.e., depth) in the arcuate shape changes.

Thus, for each of the toner images KI, CI, MI, and YI, when the image distortion occurring in the toner image at the secondary transfer position on the belt surface changes, the direction of distortion in the arcuate shape does not change (i.e., the direction in which the entire image is deformed and projected into an arcuate shape remains in the direction toward the belt conveying direction downstream side), and only the degree of distortion (i.e., depth) in the arcuate shape changes. In the color printer 1, when the amounts of image distortion occurring in the toner images KI, CI, MI, and YI at the secondary transfer position on the belt surface change, a color shift in the image vertical direction that cannot be corrected with the above described color shift correction values may occur.

In order to detect whether the amounts of image distortion occurring in the toner images KI, CI, MI, and YI at the secondary transfer position on the belt surface have changed, the color printer 100 includes the additional color shift sensor.

Figure 17:
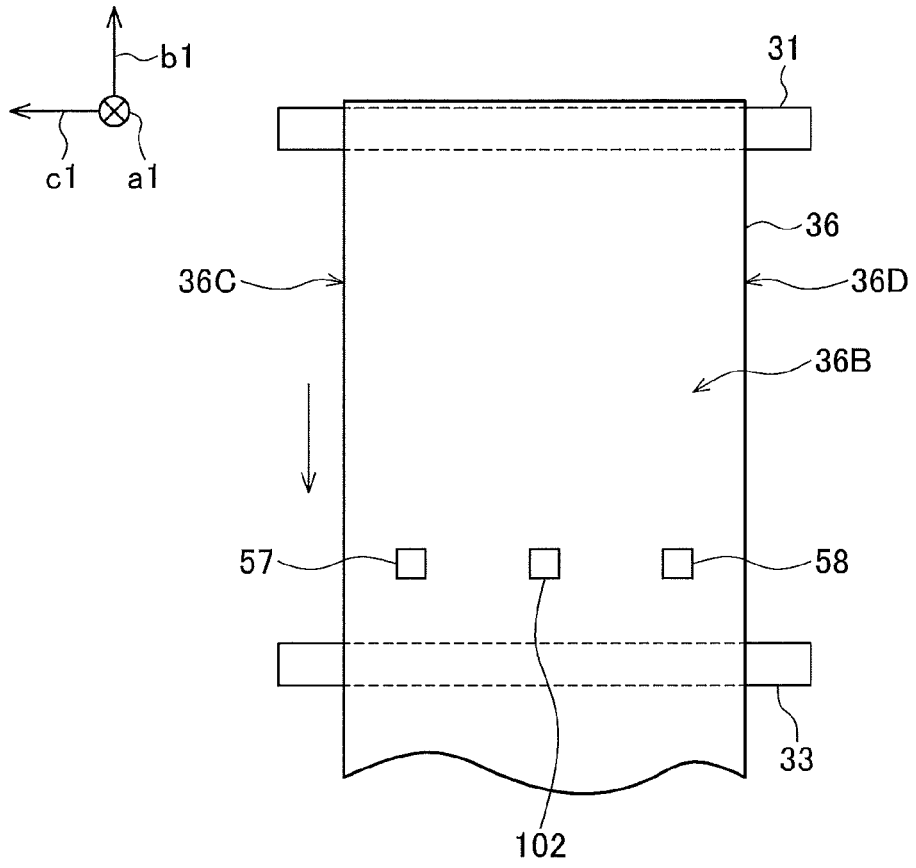
FIG. 17 is a schematic bottom view for explaining an arrangement position of a central color shift sensor.

As shown in FIG. 17, in which parts that are the same as or correspond to those in FIG. 5 have the same reference characters, in view of the fact that the amounts of image distortion occurring in the toner images KI, CI, MI, and YI changes more greatly toward the center in the image horizontal direction, the additional color shift sensor 102 is disposed between the left color shift sensor 71 and the right color shift sensor 72 so as to be aligned with them along the printer left-right direction and be close to (in a non-contact manner) the center part of the belt surface. Hereinafter, the color shift sensor 102 will be also referred to as the central color shift sensor 102.

In this embodiment, the printer controller 101 causes the first image forming unit to form a first detection image on the belt surface and causes the second image forming unit to form a second detection image on the belt surface. Then, the printer controller 101 detects the amount of displacement between the first detection image and the second detection image on a downstream side of the tension roller in the conveying direction by using the central color shift sensor 102, and performs the correction of the first and second image data based on the detected amount of displacement. This will be described more specifically below.

(2-2) Circuit Configuration of Printer Controller

Figure 18:
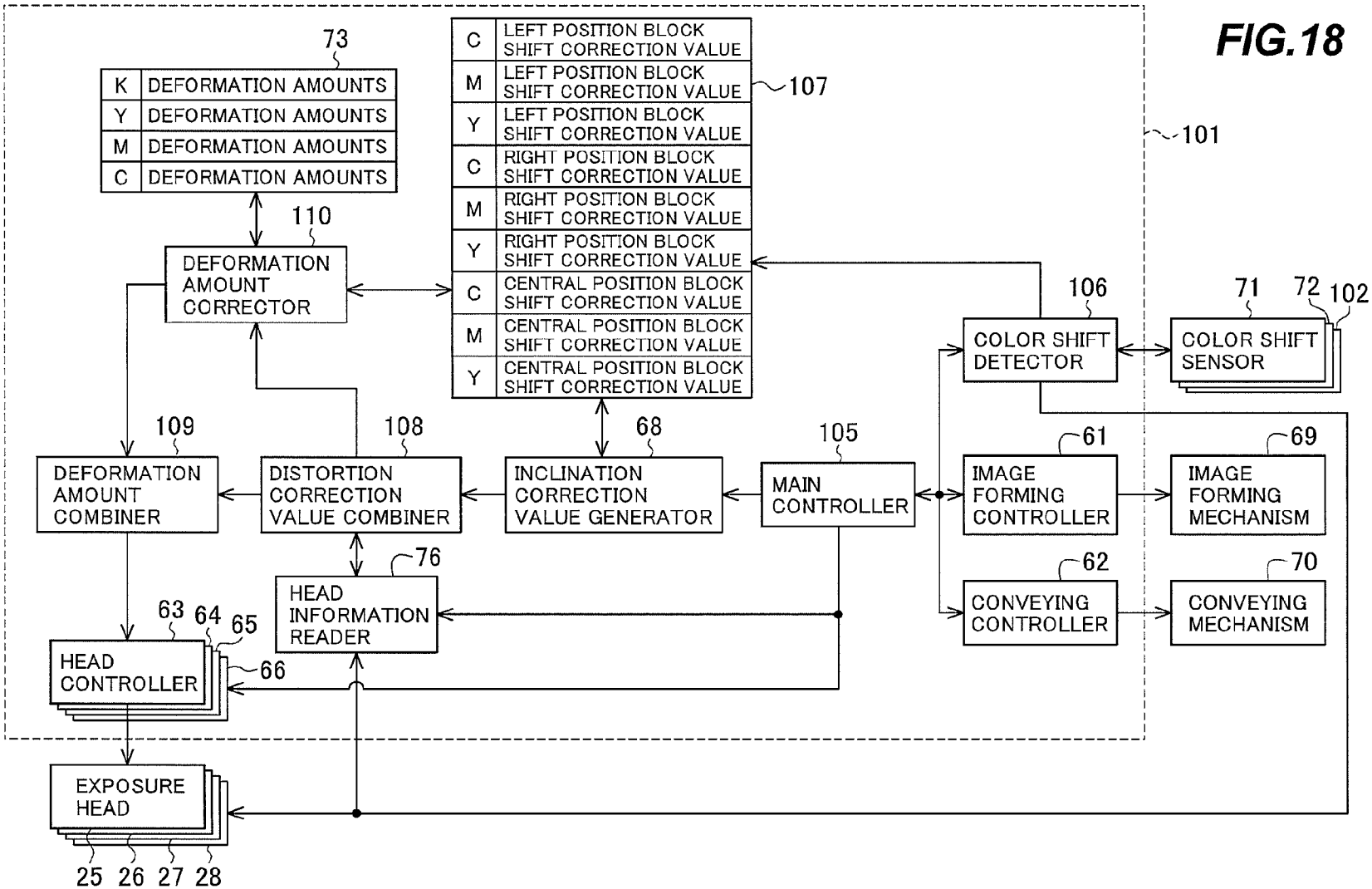
FIG. 18 is a block diagram showing a circuit configuration of a printer controller in the second embodiment.

Next, the circuit configuration of the printer controller 101 will be described with reference to FIG. 18, in which parts that are the same as or correspond to those in FIG. 2 have the same reference characters. The printer controller 101 includes a main controller 105 that controls the entire printer controller 101. The main controller 105 is configured using, for example, a microprocessor.

The main controller 105 generally executes the same processes as those of the main controller 60 in the printer controller 101 in the first embodiment. However, the main controller 105 is connected to a color shift detector 106, to which the left color shift sensor 71, right color shift sensor 72, and central color shift sensor 102 are connected.

With the additional central color shift sensor 102, in the correction value setting process, the main controller 105 executes a control partially different from that of the main controller 60 in the first embodiment and the color shift detector 106 also executes a process partially different from that of the color shift detector 67 in the first embodiment under control of the main controller 105.

As in the first embodiment, in the initial setting of the color printer 100 or upon receipt of an instruction of color shift correction from a user, the main controller 105 appropriately controls respective units to execute the correction value setting process.

At this time, the color shift detector 106 generates left position block shift correction values and right position block shift correction values for three colors (cyan, magenta, and yellow), similarly to the color shift detector 67 in the first embodiment. In addition, the color shift detector 106 drives and uses the central color shift sensor 102 so as to detect the amount of color shift.

When the predetermined number of sets of the black and cyan color shift detection images are transferred on the belt surface of the transfer belt 36, while the color shift detector 106 monitors the level of the reception light signal supplied from the central color shift sensor 102, it determines, based on the variation of the level, a matched set and a matched set position at a position (also referred to below as the central sensor facing position) facing the central color shift sensor 102 on the belt surface.

Based on the results of the determination, the color shift detector 106 detects the amount of color shift of the cyan color shift detection image relative to the black color shift detection image at the central sensor facing position. In the correction value setting process, the color shift correction using the color shift correction values is not performed. Therefore, when the black and cyan color shift detection images transferred on the belt surface are conveyed to the secondary transfer position side, different amounts of image distortion occur and a color shift occurs. Thus, the color shift detector 106 detects the amount of color shift of the cyan color shift detection image.

As in the case of detecting the presence or absence and the amount of color shift at the left sensor facing position and right sensor facing position, in accordance with the amount of color shift at the central sensor facing position, the color shift detector 106 generates a correction value (also referred to below as the central position block shift correction value) for correcting a formation position of a block BL at the central sensor facing position in the cyan color shift detection image so as to match a formation position of the corresponding block BL in the black color shift detection image.

When the color shift detector 106 generates the left position block shift correction value, right position block shift correction value, and central position block shift correction value for cyan with the black color shift detection image as a reference, it transmits and stores them into a correction value storage unit 107, which is a nonvolatile memory, such as an EEPROM, provided in the printer controller 101.

Next, similarly, the color shift detector 106 controls the head controllers 63 and 65 corresponding to black and magenta to execute the series of processes to transfer the predetermined number of sets of the black and magenta color shift detection images on the belt surface of the transfer belt 36, and generates a left position block shift correction value, a right position block shift correction value, and a central position block shift correction value for magenta with the black color shift detection image as a reference, storing them in the correction value storage unit 107.

Then, similarly, the color shift detector 106 controls the head controllers 63 and 66 corresponding to black and yellow to execute the series of processes to transfer the predetermined number of sets of the black and yellow color shift detection images on the belt surface of the transfer belt 36, and generates a left position block shift correction value, a right position block shift correction value, and a central position block shift correction value for yellow with the black color shift detection image as a reference, storing them in the correction value storage unit 107.

Upon completion of storing the left position block shift correction values, right position block shift correction values, and central position block shift correction values for the three colors (cyan, magenta, and yellow) in the correction value storage unit 107, the color shift detector 106 notifies the main controller 105 of it. Upon receiving this notification from the color shift detector 106, the main controller 105 instructs the inclination correction value generator 68 to generate inclination correction values.

Upon receiving the instruction from the main controller 105, the inclination correction value generator 68 generates inclination correction value for each block BL of the black toner image KI as described above. The inclination correction value generator 68 reads, from the correction value storage unit 107, the left position block shift correction values and right position block shift correction values for cyan, magenta, and yellow as described above, and generates inclination correction value for each block BL of the cyan, magenta, and yellow toner images CI, MI, and YI. The inclination correction value generator 68 transmits the generated inclination correction values to a distortion correction value combiner 108 and instructs the distortion correction value combiner 108 to combine the inclination correction values with distortion correction values.

Upon receiving from the inclination correction value generator 68 the instruction to combine the inclination correction values with distortion correction values, the distortion correction value combiner 108 executes the same process as that of the distortion correction value combiner 75 in the first embodiment to generate an inclination distortion correction value for each block BL of the toner images KI, CI, MI, and YI. The distortion correction value combiner 108 transmits the generated inclination distortion correction values to a deformation amount combiner 109 and instructs a deformation amount corrector 110 to correct the deformation amounts KT, CT, MT, and YT.

Upon receiving from the distortion correction value combiner 108 the instruction to correct the deformation amounts KT, CT, MT, and YT, the deformation amount corrector 110 reads the deformation amount KT for each block BL of the black toner image KI from the deformation amount storage unit 73. However, since the black toner image KI is used as a reference for correcting the other toner images CI, MI, and YI as described above, the deformation amount corrector 110 does not correct the deformation amount KT for each block BL.

Further, the deformation amount corrector 110 reads the deformation amount CT for each block BL of the cyan toner image CI from the deformation amount storage unit 73 and reads the central position block shift correction value for cyan from the correction value storage unit 107. Then, the deformation amount corrector 110 compares the number of lines indicated by the central position block shift correction value with the number of lines indicated by the deformation amount CT for a block (also referred to below as the central block) BL at a center of a line LN out of the read deformation amounts; the central block BL corresponds to the block BL at the center of a line LN at which the central position block shift correction value is obtained.

As a result, if the number of lines indicated by the deformation amount CT for the central block BL is identical to the number of lines indicated by the central position block shift correction value, since there is no change in the amount of image distortion occurring in the cyan toner image CI at the secondary transfer position at present, the deformation amount corrector 110 does not correct the deformation amount CT for each block BL.

On the other hand, if the number of lines indicated by the deformation amount CT for the central block BL is different from the number of lines indicated by the central position block shift correction value, since there is a change in the amount of image distortion occurring in the cyan toner image CI at the secondary transfer position, the deformation amount corrector 110 calculates the difference (also referred to below as the difference line number) between the number of lines indicated by the deformation amount CT and the number of lines indicated by the central position block shift correction value.

If the number of lines indicated by the central position block shift correction value is greater than that indicated by the deformation amount CT for the central block BL, the deformation amount corrector 110 adds the difference line number to the number of lines indicated by the deformation amount CT for the central block BL. For the block (also referred to below as the one end block) BL at one end of the line LN and the block (also referred to below as the other end block) BL at the other end of the line LN, the deformation amount corrector 110 adds nothing to the number of lines indicated by the deformation amount CT. For the other blocks BL other than the one end block BL, the other end block BL, and the central block BL, the deformation amount corrector 110 adds a value obtained by weighting the difference line number with a weighting factor determined in advance in accordance with the distance between the central block BL and the other block BL to the number of lines indicated by the deformation amount CT for the other block BL.

On the other hand, if the number of lines indicated by the central position block shift correction value is less than that indicated by the deformation amount CT for the central block BL, the deformation amount corrector 110 subtracts the difference line number from the number of lines indicated by the deformation amount CT for the central block BL. For the one end block BL and the other end block BL, the deformation amount corrector 110 subtracts nothing from the number of lines indicated by the deformation amount CT. For the other blocks BL other than the one end block BL, the other end block BL, and the central block BL, the deformation amount corrector 110 subtracts a value obtained by weighting the difference line number with a weighting factor determined in advance in accordance with the distance between the block BL and the central block BL to the number of lines indicated by the deformation amount CT for the block BL.

In this way, the deformation amount corrector 110 appropriately corrects the deformation amount CT (i.e., the number of lines indicated thereby) for each block BL by using the central position block shift correction value in response to the change in the amount of image distortion occurring in the cyan toner image CI at the secondary transfer position.

For each of the toner images KI, CI, MI, and YI, when the amount of image distortion occurring in the toner image at the secondary transfer position changes, the degree of deformation of the toner image into an arcuate shape changes but the deformed arcuate shape itself does not change so much. For this reason, the weighting factors for weighting the difference line number in the addition and subtraction are appropriately determined so as to gradually decrease from the central block BL toward the one end and the other end.

Thus, when the deformation amounts CT for the respective blocks BL before correction are represented as an arcuate pre-correction curve along the line LN as shown in FIG. 10, for example, the deformation amount corrector 110 corrects the deformation amounts CT for the respective blocks BL so that they are represented as an arcuate approximation curve with respect to the pre-correction curve as a whole, each end of the approximation curve being at the same position as that of the pre-correction curve, the center of the approximation curve being separated from the center of the pre-correction curve outward or inward by a distance corresponding to the difference line number. Thereby, the deformation amount corrector 110 can adapt the deformation amounts CT for the respective blocks BL to the change in the amount of image distortion occurring in the cyan toner image CI at the secondary transfer position.

Further, the deformation amount corrector 110 reads the deformation amount MT for each block BL of the magenta toner image MI from the deformation amount storage unit 73 and reads the central position block shift correction value for magenta from the correction value storage unit 107. The deformation amount corrector 110 executes the same process as for the deformation amount CT for each block BL of the cyan toner image CI, thereby applying no correction to the deformation amount MT for each block BL of the magenta toner image MI or correcting the deformation amount MT for each block BL in response to the change in the amount of image distortion occurring in the magenta toner image MI at the secondary transfer position.

Further, the deformation amount corrector 110 reads the deformation amount YT for each block BL of the yellow toner image YI from the deformation amount storage unit 73 and reads the central position block shift correction value for yellow from the correction value storage unit 107. The deformation amount corrector 110 executes the same process as for the deformation amount CT for each block BL of the cyan toner image CI, thereby applying no correction to the deformation amount YT for each block BL of the yellow toner image YI or correcting the deformation amount YT for each block BL in response to the change in the amount of image distortion occurring in the yellow toner image YI at the secondary transfer position.

Upon completion of the above described series of processes, the deformation amount corrector 110 transmits the uncorrected deformation amounts KT for the respective blocks BL of the black toner image KI to the deformation amount combiner 109. For each of cyan, magenta, and yellow, when the deformation amounts for the respective blocks BL of the toner image have not been corrected, the deformation amount corrector 110 transmits the uncorrected deformation amounts for the respective blocks BL of the toner image to the deformation amount combiner 109; when the deformation amounts for the respective blocks BL of the toner image have been corrected, the deformation amount corrector 110 transmits the corrected deformation amounts for the respective blocks BL of the toner image to the deformation amount combiner 109. Then, the deformation amount corrector 110 instructs the deformation amount combiner 109 to combine the inclination distortion correction values with the deformation amounts KT, CT, MT, and YT.

When the deformation amount combiner 109 receives from the deformation amount corrector 110 the instruction to combine the inclination distortion correction values with the deformation amounts KT, CT, MT, and YT, it combines, for each block BL of the toner images KI, CI, MI, and YI, the deformation amount supplied form the deformation amount corrector 110 with the inclination distortion correction value supplied from the distortion correction value combiner 108 similarly to the deformation amount combiner 77 in the first embodiment, thereby generating color shift correction value for each block BL of the toner images KI, CI, MI, and YI.

Further, the deformation amount combiner 109 obtains a delay greatest line number for each of the toner images KI, CI, MI, and YI similarly to the deformation amount combiner 77 in the first embodiment. The deformation amount combiner 109 transmits and stores the color shift correction value for each block BL of the toner images KI, CI, MI, and YI and the delay greatest line number for each of the toner images KI, CI, MI, and YI into the corresponding head controllers 63 to 66. Then, the main controller 105 ends the correction value setting process.

In this way, even if the amounts of image distortion occurring in the toner images KI, CI, MI, and YI at the secondary transfer position on the belt surface change, the main controller 105 can correct the deformation amount for each block BL of the cyan, magenta, and yellow toner images CI, MI, and YI in accordance with the amounts of change in the image distortion of the toner images CI, MI, and YI with the amount of change in the image distortion of the black toner image KI as a reference.

The main controller 105 can also correct the color shift correction values for the respective blocks BL of the toner images CI, MI, and YI to include the components of the corrected deformation amounts CT, MT, and YT for the respective blocks BL of the toner images CI, MI, and YI.

In formation of a print image, the main controller 105 causes the head controllers 63 to 66 to appropriately control the timings for transmitting the data blocks constituting the head control data by using the color shift correction values for the respective blocks BL of the toner images KI, CI, MI, and YI to reconfigure the head control data for each line LN and transmit them to the respective exposure heads 25 to 28.

Thus, when the toner images KI, CI, MI, and YI formed on the drum surfaces of the photosensitive drums 20 to 23 by the image forming units 10 to 13 through the electrostatic latent images EI are sequentially transferred and superposed on the belt surface of the transfer belt 36 and conveyed to the secondary transfer position, the main controller 105 can substantially match the shape of each of the cyan, magenta, and yellow toner images CI, MI, and YI with that of the black toner image KI.

Therefore, the main controller 105 can prevent the color shift in the image vertical direction from occurring in the toner images KI, CI, MI, and YI at the secondary transfer position on the belt surface, and transfer the toner images KI, CI, MI, and YI onto a surface of a recording paper 5 at the secondary transfer position.

(2-3) Operation and Advantage of Second Embodiment

In the above configuration, the printer controller 101 of the color printer 100 detects the amounts of color shift of the toner images KI, CI, MI, and YI on the belt surface of the transfer belt 36 and generates, based on the detected color shift amounts, the central position block shift correction values for correcting the color shift of the toner images KI, CI, MI, and YI.

The printer controller 101 of the color printer 100 compares the central position block shift correction values with the deformation amounts KT, CT, MT, and YT, and if they are different, corrects the deformation amounts KT, CT, MT, and YT based on the central position block shift correction value and stores the corrected deformation amounts.

In formation of a print image, the printer controller 101 of the color printer 100 controls the image forming units 10 to 13 based on the corrected deformation amounts KT, CT, MT, and YT to form the toner images KI, CI, MI, and YI while appropriately deforming the toner images in advance, and sequentially transfers the toner images KI, CI, MI, and YI onto the belt surface of the transfer belt 36 in a superposed manner, conveying them to the secondary transfer position.

Thus, even if the amount of belt distortion has changed, when the toner images KI, CI, MI, and YI on the belt surface of the transfer belt 36 are conveyed to the secondary transfer position, the color printer 100 can substantially match the shapes of the toner images KI, CI, MI, and YI with each other and almost certainly prevent the occurrence of color shift.

As described above, the color printer 100 is configured as follows: the printer controller 101 detects the amounts of color shift of the toner images KI, CI, MI, and YI on the belt surface of the transfer belt 36 and appropriately corrects the deformation amounts KT, CT, MT, and YT; in formation of a print image, the printer controller 101 controls the image forming units 10 to 13 based on the appropriately corrected deformation amounts KT, CT, MT, and YT to form the toner images KI, CI, MI, and YI while appropriately deforming them in advance, and sequentially transfers the toner images KI, CI, MI, and YI onto the belt surface of the transfer belt 36 in a superposed manner, conveying them to the secondary transfer position.

Thus, the color printer 100 can achieve the same advantages as those of the first embodiment; in addition, even if the amount of belt distortion of the transfer belt 36 has changed, the color printer 100 can substantially match the shapes of the toner images KI, CI, MI, and YI with each other at the secondary transfer position, and almost certainly prevent the occurrence of color shift, thereby reducing the deterioration of a print image.

(3) Other Embodiments

The above first and second embodiments illustrate a case where the color printer 1 or 100 includes the four image forming units 10 to 13 for forming toner images KI, CI, MI, and YI of four colors. However, the color printer 1 or 100 may include two or more image forming units for forming toner images of two or more colors.

Further, the above first and second embodiments illustrate a case where the color printer forms the toner images KI, CI, MI, and YI by the respective image forming units 10 to 13 while correcting the line inclinations and line distortions by deforming the toner images based on the color shift correction values for the toner images KI, CI, MI, and YI. However, it is also possible to form the toner images KI, CI, MI, and YI by the respective image forming units 10 to 13 while deforming the toner images based on only the deformation amounts KT, CT, MT, and YT for the toner images KI, CI, MI, and YI.

The present invention may be applied to an image forming apparatus, such as a multi-function printer, a facsimile machine, a multi-function peripheral, and a copier, of intermediate transfer type.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an endless belt having a surface on which a first image and a second image are sequentially formed in a superposed manner, the first image and the second image having different colors, the belt conveying the first image and the second image in a conveying direction;

a drive roller that supports the belt and drives the belt in the conveying direction;

a tension roller that supports the belt on a downstream side of the drive roller in the conveying direction so as to stretch the belt together with the drive roller;

a first image forming unit that is disposed to face the surface of the belt at a first position on an upstream side of the tension roller in the conveying direction and forms the first image;

a second image forming unit that is disposed to face the surface of the belt at a second position on an upstream side of the first image forming unit in the conveying direction and forms the second image; and a controller that obtains first image data for forming the first image and second image data for forming the second image, corrects the obtained first and second image data so as to compensate a distortion of the second image occurring during conveyance of the second image from the second position to the first position, and causes the first and second image forming units to form the first and second images based on the corrected first and second image data.

2. The image forming apparatus of claim 1, wherein the controller corrects the first image data so as to deform an image represented by the first image data by a first amount, and corrects the second image data so as to deform an image represented by the second image data by a second amount different from the first amount.

3. The image forming apparatus of claim 2, wherein a difference between the first amount and the second amount corresponds to the amount of the distortion of the second image.

4. The image forming apparatus of claim 1, comprising a plurality of image forming units including the first and second image forming units, each of the plurality of image forming units being disposed to face the surface of the belt on the upstream side of the tension roller in the conveying direction, wherein the first image forming unit is disposed on the most downstream side in the conveying direction among the plurality of image forming units so as to be adjacent to the tension roller, and forms a black image as the first image.

5. The image forming apparatus of claim 4, wherein the controller does not correct the first image data.

6. The image forming apparatus of claim 1, wherein the controller:

causes the first image forming unit to form a first detection image on the surface and causes the second image forming unit to form a second detection image on the surface;

detects the amount of displacement between the first detection image and the second detection image on a downstream side of the tension roller in the conveying direction; and performs the correction of the first and second image data based on the detected amount of displacement.

7. The image forming apparatus of claim 1, wherein:

the first image data include a plurality of data blocks corresponding to a plurality of blocks constituting the first image;

the second image data include a plurality of data blocks corresponding to a plurality of blocks constituting the second image;

the controller transmits the plurality of data blocks of the first image data to the first image forming unit and transmits the plurality of data blocks of the second image data to the second image forming unit;

the first image forming unit forms the plurality of blocks of the first image based on the plurality of data blocks of the first image data according to the order in which the plurality of data blocks of the first image data are transmitted to the first image forming unit;

the second image forming unit forms the plurality of blocks of the second image based on the plurality of data blocks of the second image data according to the order in which the plurality of data blocks of the second image data are transmitted to the second image forming unit;

the controller obtains a first correction value and a second correction value for compensating the distortion of the second image;

the controller corrects the first image data by controlling the order in which the plurality of data blocks of the first image data are transmitted to the first image forming unit, by the data block, based on the first correction value; and the controller corrects the second image data by controlling the order in which the plurality of data blocks of the second image data are transmitted to the second image forming unit, by the data block, based on the second correction value.

8. The image forming apparatus of claim 7, wherein the controller:

obtains a first inclination correction value and a second inclination correction value for compensating a difference between an inclination of the first image occurring in the formation of the first image and an inclination of the second image occurring in the formation of the second image;

corrects the first image data by controlling the order based on the first correction value and the first inclination correction value; and corrects the second image data by controlling the order based on the second correction value and the second inclination correction value.

9. The image forming apparatus of claim 8, wherein:

one of the first and second images is a black image;

one of the first and second inclination correction values corresponding to the one image indicates that one of the first and second image data corresponding to the one image are not corrected; and the other of the first and second inclination correction values indicates that the other of the first and second image data are corrected.

10. The image forming apparatus of claim 7, wherein the controller:

obtains a first distortion correction value and a second distortion correction value for compensating a difference between a distortion of the first image occurring in the formation of the first image and a distortion of the second image occurring in the formation of the second image;

corrects the first image data by controlling the order based on the first correction value and the first distortion correction value; and corrects the second image data by controlling the order based on the second correction value and the second distortion correction value.

11. The image forming apparatus of claim 10, wherein:

one of the first and second images is a black image;

one of the first and second distortion correction values corresponding to the one image indicates that one of the first and second image data corresponding to the one image are not corrected; and the other of the first and second distortion correction values indicates that the other of the first and second image data are corrected.

* * * * *